US010712712B2

(12) United States Patent
Sakai et al.

(10) Patent No.: US 10,712,712 B2
(45) Date of Patent: Jul. 14, 2020

(54) TIMEPIECE

(71) Applicant: SEIKO INSTRUMENTS INC., Chiba-shi, Chiba (JP)

(72) Inventors: Satoshi Sakai, Chiba (JP); Tomohiro Ihashi, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 140 days.

(21) Appl. No.: 15/867,307

(22) Filed: Jan. 10, 2018

(65) Prior Publication Data

US 2018/0203417 A1 Jul. 19, 2018

(30) Foreign Application Priority Data

Jan. 13, 2017 (JP) ..... 2017-003982

(51) Int. Cl.
*G04F 7/08* (2006.01)
*G04C 17/00* (2006.01)

(52) U.S. Cl.
CPC ..... *G04F 7/0876* (2013.01); *G04C 17/00* (2013.01)

(58) Field of Classification Search
CPC . G04F 7/00; G04F 7/08; G04F 7/0804; G04F 7/0876; G04F 8/00
See application file for complete search history.

(56) References Cited

U.S. PATENT DOCUMENTS 4,523,857 A * 6/1985 Ushikoshi ..... G04C 3/146 368/107
5,959,941 A * 9/1999 Murakami ..... G04F 8/00 368/110
9,354,610 B2 * 5/2016 Okeya ..... G04F 8/006
2004/0264303 A1 * 12/2004 Brida ..... G04B 19/28 368/110
2010/0182878 A1 * 7/2010 Meis ..... G04F 7/0876 368/81
2016/0124392 A1 * 5/2016 Genoud ..... G04F 7/065 368/102

OTHER PUBLICATIONS

Abstract, Publication No. JP 05-196756, Publication date Aug. 6, 1993.

* cited by examiner

*Primary Examiner* — Edwin A. Leon
*Assistant Examiner* — Jason M Collins
(74) *Attorney, Agent, or Firm* — Adams & Wilks

(57) ABSTRACT

A timepiece capable of selecting a timepiece mode and a chronograph mode includes an hour hand and a minute hand which indicate current time in a case where the timepiece mode is, selected. A main control unit performs control so as to start measuring time by simultaneously starting hand operations of the hour hand and the minute hand in a case where the chronograph mode is selected. When the hand operation of one of the hands is stopped, the control unit performs control so as to indicate the time when the hand operation of the one hand is stopped, and to continue to measure the time by continuing the hand operation of the other hand.

16 Claims, 12 Drawing Sheets

TIMEPIECE

BACKGROUND OF THE INVENTION

Field of the Invention

The present invention relates to a timepiece.

Background Art

An electronic timepiece is known which can measure a split time or a lap time by performing a button operation. For example, as a digital timepiece, JP-A-5-196756 discloses a stop watch having a display unit that displays an elapsed time elapsed from a start operation, the lap time, and the split time. The split time means an intermediate elapsed time from a measurement start time, and the lap time means an intermediate elapsed time from a designated time during the measurement.

As an analog timepiece which can measure the split time, a hand whose hand operation is started at the time measurement is stopped by performing the button operation for measuring the split time, thereby indicating the split time. However, in this timepiece, the hand operation of the hand is stopped in order to indicate the split time. Consequently, the elapsed time from the measurement start time cannot be recognized after the button operation is performed.

Therefore, as the analog timepiece which can measure the split time, at the time measurement, two hands (hereinafter, referred to as "chronograph hands") different from an hour hand, a minute hand, and a second hand simultaneously display both the split time and a total elapsed time from the measurement start time. Specifically, in this timepiece, the hand operations are performed at substantially the same speed so that the two chronograph hands overlap each other during the time measurement. The hand operation of one chronograph hand is stopped by performing the button operation for measuring the split time, and the split time is displayed. The hand operation of the other chronograph hand is continued, and the total elapsed time from the measurement start time is displayed even after the button operation is performed. The button operation is performed again so that one chronograph hand whose hand operation is stopped is forwarded fast to a position of the other chronograph hand. In a state where the two chronograph hands overlap each other again, the hand operations are performed so that the two chronograph hands display the total elapsed time from the measurement start time.

SUMMARY OF THE INVENTION

However, according to the above-described analog timepiece in the related art, in order to simultaneously display both the split time and the total elapsed time from the measurement start time, it is necessary to provide the two chronograph hands different from the hour hand, the minute hand, and the second hand. Therefore, it is also necessary to provide a drive source such as a motor for separately driving the two chronograph hands and a train wheel for transmitting a drive force of the drive source. Accordingly, the number of configuration components of the timepiece increases, thereby causing a possibility that the timepiece may fail to achieve miniaturization.

Therefore, according to the present invention, there is provided a timepiece capable of suppressing a device size increase in the timepiece which causes an analog hand to display a time measured using chronograph.

According to an aspect of the present invention, there is provided a timepiece capable of selecting a timepiece mode and a chronograph mode. The timepiece includes an hour hand, a minute hand, and a second hand which indicate a time in a case where the timepiece mode is selected, and a control unit that performs control so as to start time measurement by simultaneously starting hand operations of at least two hands of the hour hand, the minute hand, and the second hand in a case where the chronograph mode is selected, to indicate a measured time at the time of stopping by stopping the hand operation of one hand in at least the two hands, and to continue the time measurement by continuing the hand operation of the other hand in at least the two hands.

In the aspect, the timepiece may further include a first motor that drives the hour hand, a second motor that drives the minute hand, and a third motor that drives the second hand. In the case where the timepiece mode is selected, the control unit may cause the first motor, the second motor, and the third motor to drive the hour hand, the minute hand, and the second hand, and in the case where the chronograph mode is selected, the control unit may cause at least two motors of the first motor, the second motor, and the third motor to drive at least the two hands.

In the aspect, the timepiece may further include train wheel mechanism configured to have the same number of steps applied to one round of at least the two hands.

In the timepiece, the control unit may control the hour hand and the minute hand in the timepiece mode so as to serve as at least the two hands in the chronograph mode, which are the hands for indicating a second of the measured time.

In the timepiece, in the case where the chronograph mode is selected, when the hand operation of one hand restarts, the control unit may perform control so that one hand is forwarded fast to a position of the other hand in a clockwise direction.

In the timepiece, in a case where the chronograph mode is selected and one minute or a longer time elapses until the hand operation of one hand restarts from when the hand operation of one hand stops, the control unit may cause one hand to rotate at least one round.

In the timepiece, at least the two hands may include a 1st hand and a 2nd hand. In the case where the chronograph mode is selected, the control unit may perform a hand operation starting step of controlling the 1st hand and the 2nd hand so as to perform each hand operation from a reference position, a hand operation stopping step of stopping the hand operation of the 1st hand and the 2nd hand, a hand position determination step of determining whether or not the 1st hand and the 2nd hand, each hand operation of which is stopped, are located outside a predetermined angular range deviated from the reference position, a two-way hand returning step of moving the 1st hand and the 2nd hand to the reference position by rotating the 1st hand and the 2nd hand in mutually opposite directions, in a case where it is determined in the hand position determination step that the 1st hand and the 2nd hand are located outside the predetermined angular range deviated from the reference position, and a shortest hand returning step of moving the 1st hand and the 2nd hand to the reference position by using a shortest distance, in a case where it is determined in the hand position determination step that at least one hand of the 1st hand and the 2nd hand is not located outside the predetermined angular range deviated from the reference position.

In the timepiece, in a case where the control unit switches the chronograph mode to an operation mode including the timepiece mode other than the chronograph mode, the control unit may control a pair of hands included in at least the two hands so as to respectively rotate to each target position of the pair of two hands in mutually opposite directions.

In the timepiece, in the pair of hands included in at least the two hands, the control unit may control one hand having a short distance from a current position to the target position in a counterclockwise direction so as to rotate rearward counterclockwise, and may control the other hand so as to rotate forward clockwise.

In the timepiece, the control unit may perform control so that the second hand in the case where the timepiece mode is selected functions as a hand for indicating a minute of the measured time in the case where the chronograph mode is selected.

In the aspect, the timepiece may further include a first motor that drives the hour hand, a second motor that drives the minute hand, and a solar battery that generates power for driving the first motor and the second motor.

In the aspect, the timepiece may further include a train wheel mechanism configured to have the same number of steps applied to one round of at least the two hands. The number of steps may be a multiple of 60.

In the aspect, the timepiece may further include a train wheel mechanism configured to have the same number of steps applied to one round of at least the two hands. When N is an integer equal to or greater than 1, the number of steps may be a value obtained by multiplying 60 by the N-th power of 2.

In the aspect, the timepiece may further include an auxiliary display unit capable of displaying information of a mode different from the timepiece mode and the chronograph mode. In the case where the chronograph mode is selected, the control unit may cause the auxiliary display unit to display the time displayed in the case where the timepiece mode is selected.

In the aspect, the timepiece may further include a communication unit capable of at least any one of transmitting the measured time at the time of stopping to an external device and receiving an external radio wave for performing at least one process of a process for starting and a process for stopping the hand operation of one hand.

In the aspect, the timepiece may further include an input unit that is operated in a case of selecting the chronograph mode or in a case of starting the time measurement in the case where the chronograph mode is selected. In accordance with an input from the input unit, the control unit may move at least the two hands toward each reference position, and may start the time measurement.

In another aspect of the present invention, there is provided a timepiece capable of selecting a timepiece mode for causing an hour hand, a minute hand, and a second hand to display a time, and a chronograph mode for causing at least one hand of the hour hand, the minute hand, and the second hand to display a split time.

According to the aspect of the present invention, it is possible to suppress a size increase in a timepiece which causes an analog hand to display a measured time of a chronograph.

DETAILED DESCRIPTION OF THE INVENTION

Figure 1:
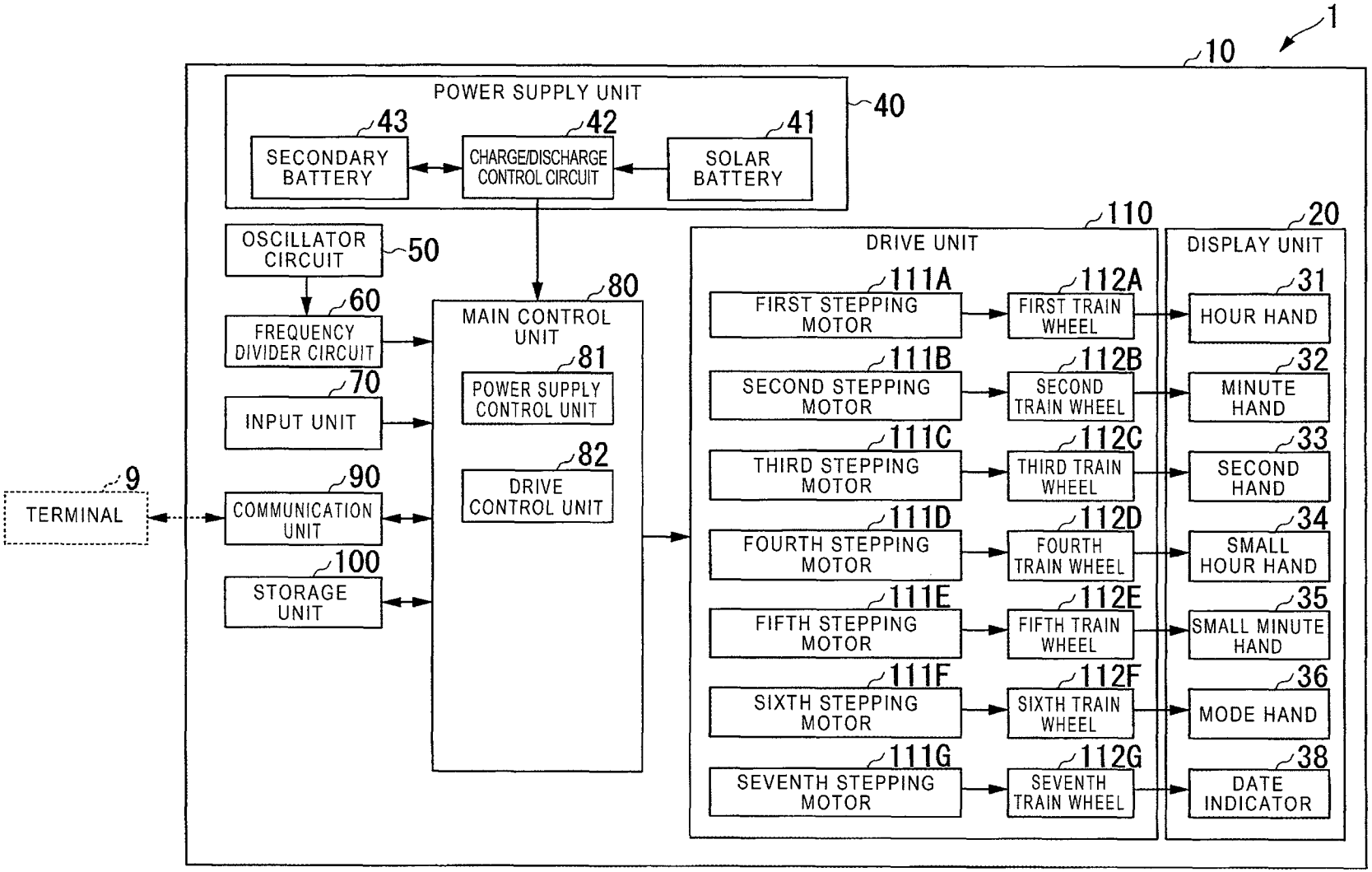
FIG. 1 is a block diagram illustrating a configuration example of a timepiece according to a first embodiment.

Hereinafter, embodiments according to the present invention will be described with reference to the drawings. In the following description, the same reference numerals will be given to configurations having the same or similar functions. In some cases, repeated description of the configurations may be omitted. A timepiece according to the embodiments is an analog quartz timepiece having a hand.

First Embodiment

First, a configuration of a timepiece according to a first embodiment will be described.

FIG. 1 is a block diagram illustrating a configuration example of the timepiece according to the first embodiment.

As illustrated in FIG. 1, a timepiece 1 includes a case 10, a display unit 20, a power supply unit 40, an oscillator circuit 50, a frequency divider circuit 60, an input unit 70, a main control unit 80 (control unit), a communication unit 90, a storage unit 100, and a drive unit 110. The timepiece 1 is capable of selecting an operation mode such as a timepiece mode for displaying a current time in a main timepiece unit 2 (to be described later), a chronograph mode for performing time measurement in the main timepiece unit 2, a timer mode for displaying a remaining time in the main timepiece unit 2, and a dual time mode for displaying a current time in a preset time zone in the main timepiece unit 2. The operation mode can be selected by a user operating the input unit 70. The timepiece 1 communicates with a terminal 9 (external device) via a wireless network so as to transmit and receive information.

The terminal 9 is a device having a communication function, for example, a smartphone or a tablet terminal. For example, the terminal 9 includes an operation unit, a display unit, a control unit, a global positioning system (GPS), a communication unit, and a battery. The terminal 9 transmits time information, position information, and an operation instruction which are acquired using the GPS to the timepiece 1 via the network.

Case

Figure 2:
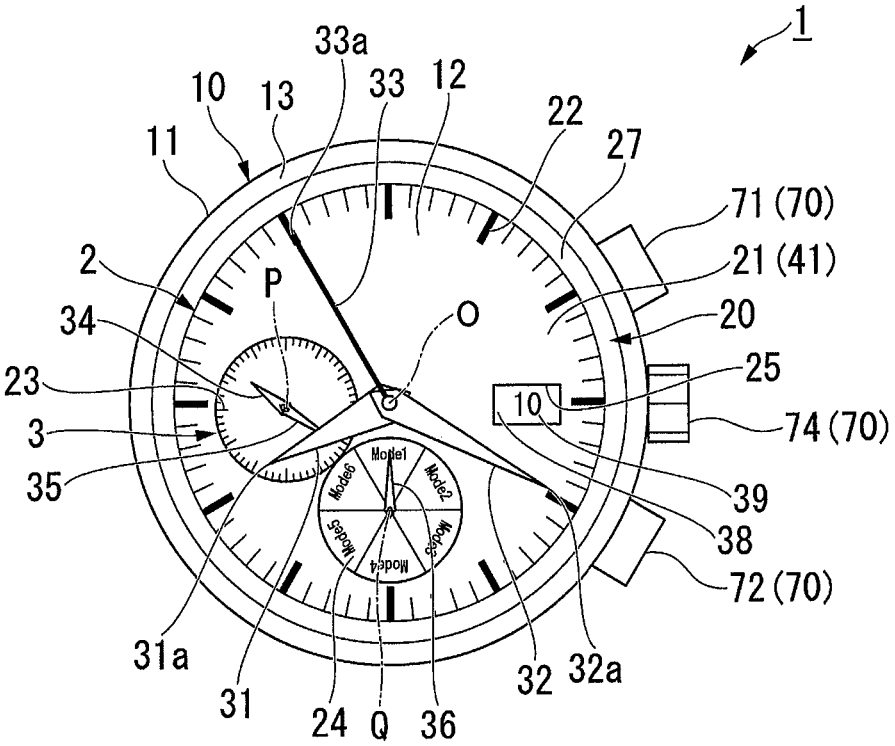
FIG. 2 is a plan view of the timepiece according to the first embodiment.

FIG. 2 is a plan view of the timepiece according to the first embodiment.

As illustrated in FIG. 2, the case 10 includes a case body 11, a case back (not illustrated), a glass 12, and a bezel 13. The case body 11 is formed in a cylindrical shape. The bezel 13 is fitted to the case body 11. One opening of the case body 11 is closed by the glass 12 via the bezel 13. The other opening of the case body 11 is closed by the case back (not illustrated). In the following description, the glass 12 side when viewed from the case back of the case 10 will be referred to as a front side and a side opposite thereto will be referred to as a rear side.

Display Unit

The display unit 20 includes a dial 21, a dial ring 27, a plurality of hands 31 to 36, and a date indicator 38. The display unit 20 may include the above-described bezel 13. The plurality of hands 31 to 36 are an hour hand 31, a minute hand 32, and a second hand 33 which are capable of displaying a time, a small hour hand 34 and a small minute hand 35 which are capable of displaying a time different from the time displayed by the hour hand 31, the minute hand 32, and the second hand 33, and a mode hand 36 capable of displaying information of a mode performed by the timepiece 1. The dial 21 is formed in a circular shape having a solar battery 41 (to be described later), and is disposed inside the case body 11 of the case 10. The front side of the dial 21 includes a main scale 22 corresponding to the hour hand 31, the minute hand 32, and the second hand 33, a small scale 23 corresponding to the small hour hand 34 and the small minute hand 35, a mode scale 24 corresponding to mode hand 36, and a small window 25 displaying a date character 39 of the date indicator 38. The mode scale 24 is a character string in which names of various modes which can be performed by the timepiece 1 are clearly shown.

The dial ring 27 is attached to an inner periphery of the bezel 13 inside the case body 11 of the case 10. The dial ring 27 is disposed along an outer periphery of the dial 21.

The plurality of hands 31 to 36 are respectively disposed on the front side of the dial 21.

The hour hand 31, the minute hand 32, and the second hand 33 rotate around a first rotation axis O passing through the center of the dial 21. The hour hand 31 extends along a direction orthogonal to the first rotation axis O. The minute hand 32 extends longer than the hour hand 31 along the direction orthogonal to the first rotation axis O. A tip 32*a* of the minute hand 32 is located farther away from the first rotation axis O than a tip 31*a* of the hour hand 31, and is located closer to the dial ring 27 than the tip 31*a* of the hour hand 31. The second hand 33 extends longer than the minute hand 32 along the direction orthogonal to the first rotation axis O. A tip 33*a* of the second hand 33 is located farther away from the first rotation axis O than the tip 32*a* of the minute hand 32, and is located closer to the dial ring 27 than the tip 32*a* of the minute hand 32.

The hour hand 31, the minute hand 32, and the second hand 33 indicate a time in a case where the timepiece mode is selected by adjusting the tips 31*a* to 33*a* to the main scale 22 of the dial 21, and indicate a measured time in a case where the chronograph mode is selected. In this manner, the hour hand 31, the minute hand 32, the second hand 33, and the main scale 22 configure a main timepiece unit 2 which displays the time and the measured time.

The small hour hand 34 and the small minute hand 35 rotate around a second rotation axis P. The second rotation axis P is disposed at a position in a direction of 9 o'clock when viewed from the first rotation axis O. The small hour hand 34 extends along a direction orthogonal to the second rotation axis P. The small minute hand 35 extends longer than the small hour hand 34 along the direction orthogonal to the second rotation axis P.

The small hour hand 34 and the small minute hand 35 are formed to be capable of indicating the time by adjusting the tips to the small scale 23 of the dial 21. In this manner, the small hour hand 34, the small minute hand 35, and the small scale 23 configure a small timepiece unit 3 (auxiliary display unit) for displaying the time. The small timepiece unit 3 is capable of displaying information of a mode different from the timepiece mode and the chronograph mode. In a case where the chronograph mode is selected, the small timepiece unit 3 displays a current time displayed in the main timepiece unit 2 in a case where the timepiece mode is selected.

The mode hand 36 rotates around a third rotation axis Q. The third rotation axis Q is disposed at a position in a direction of 6 o'clock direction when viewed from the first rotation axis O. For example, the mode hand 36 indicates a mode which can be performed by a user or a mode performed in the timepiece 1 by adjusting the tip to the mode scale 24 of the dial 21.

The date indicator 38 is disposed on the rear side of the dial 21. The date indicator 38 rotates around the first rotation axis O. A side facing the front side of the date indicator 38 clearly shows the date character 39. The date indicator 38 displays a date by exposing the date character 39 to the front side through the small window 25 of the dial 21.

Power Supply Unit

As illustrated in FIG. 1, the power supply unit 40 includes the solar battery 41, a charge/discharge control circuit 42, and a secondary battery 43.

For example, the solar battery 41 is a solar panel, and forms the dial 21. The solar battery 41 is disposed in a state where a light receiving surface faces the front side. The solar battery 41 converts light energy into electric power, and supplies the converted electric power to the secondary battery 43 via the charge/discharge control circuit 42.

The secondary battery 43 is a storage battery which stores the electric energy supplied from the solar battery 41. For example, the secondary battery 43 is a lithium ion polymer battery. The secondary battery 43 supplies the stored electric power to the main control unit 80 and the communication unit 90.

The charge/discharge control circuit 42 controls the secondary battery 43 to be charged with the electric power generated by the solar battery 41. The charge/discharge control circuit 42 controls the electric power stored in the secondary battery 43 to be supplied to the main control unit 80 and the communication unit 90.

Oscillator Circuit

The oscillator circuit 50 realizes an oscillator by being combined with a crystal oscillator. The oscillator circuit 50 outputs a generated signal having a predetermined frequency to the frequency divider circuit 60.

Frequency Divider Circuit

The frequency divider circuit 60 divides the signal having the predetermined frequency output by the oscillator circuit 50, and outputs the divided signal to the main control unit 80.

Input Unit

The input unit 70 is operated in a case of selecting the operation mode or in a case of starting the time measurement when the chronograph mode is selected. The input unit 70 includes a start/stop button 71, a reset button 72, and a crown 74. The input unit 70 is disposed on a side surface of the case body 11 of the case 10. The start/stop button 71 is disposed at a position in a direction of 2 o'clock when viewed from the first rotation axis O. The reset button 72 is disposed at a position in a direction of 4 o'clock when viewed from the first rotation axis O. The crown 74 is disposed between the start/stop button 71 and the reset button 72. In a case where the input unit 70 is operated (for example, a pressing operation or a rotation operation) by a user, the input unit 70 outputs an operation signal corresponding to the operation to the main control unit 80.

Main Control Unit

The main control unit 80 controls each configuration element included in the timepiece 1, based on an operation result output by the input unit 70. The main control unit 80 includes a power supply control unit 81 and a drive control unit 82.

The power supply control unit 81 lowers a voltage value of the electric power supplied from the secondary battery 43 down to a desired voltage value, and supplies the electric power to each circuit.

For example, the drive control unit 82 is a motor drive integrated circuit (IC). The drive control unit 82 generates a drive signal for driving the drive unit 110, and drives the drive unit 110 by using the generated drive signal.

Communication Unit

For example, the communication unit 90 transmits and receives various types of information to and from an external device such as the terminal 9 by using a communication method of a Wireless Fidelity (Wi-Fi) standard or a Bluetooth (registered trademark) low energy (LE) standard. The communication unit 90 outputs the information received from the terminal 9 to the main control unit 80. The communication unit 90 transmits the information output by the main control unit 80 to the terminal 9. For example, the communication unit 90 transmits the information on the time measured in the chronograph mode, to the terminal 9.

Storage Unit

For example, the storage unit 100 is a nonvolatile storage medium such as a random access memory (RAM) and a read only memory (ROM). The storage unit 100 stores the information obtained by the main control unit 80 from the terminal 9 via the communication unit 90, or the time measured in the chronograph mode.

Drive Unit

The drive unit 110 includes a plurality of stepping motors 111A to 111G and a plurality of train wheels 112A to 112G. The plurality of stepping motors 111A to 111G are the first stepping motor 111A (first motor), the second stepping motor 111B (second motor), the third stepping motor 111C (third motor), the fourth stepping motor 111D, the fifth stepping motor 111E, the sixth stepping motor 111F, and the seventh stepping motor 111G. The plurality of train wheels 112A to 112G are the first train wheel 112A (train wheel mechanism), the second train wheel 112B (train wheel mechanism), the third train wheel 112C, the fourth train wheel 112D, the fifth train wheel 112E, the sixth train wheel 112F, and the seventh train wheel 112G, and are configured to respectively include at least one gear. The plurality of stepping motors 111A to 111G and the plurality of train wheels 112A to 112G are attached to a main plate (not illustrated) disposed inside the case body 11 of the case 10.

The respective stepping motors 111A to 111G are operated using a drive pulse output by the drive control unit 82. The first stepping motor 111A rotationally drives the hour hand 31 via the first train wheel 112A. The second stepping motor 111B rotationally drives the minute hand 32 via the second train wheel 112B. The third stepping motor 111C rotationally drives the second hand 33 via the third train wheel 112C. The fourth stepping motor 111D rotationally drives the small hour hand 34 via the fourth train wheel 112D. The fifth stepping motor 111E rotationally drives the small minute hand 35 via the fifth train wheel 112E. The sixth stepping motor 111F rotationally drives the mode hand 36 via the sixth train wheel 112F. The seventh stepping motor 111G rotationally drives the date indicator 38 via the seventh train wheel 112G.

A speed reduction ratio of the first train wheel 112A is set so that the hour hand 31 is rotated once around the first rotation axis O by the first stepping motor 111A operated as many as a predetermined number of steps. A speed reduction ratio of the second train wheel 112B is set so that the minute hand 32 is rotated once around the first rotation axis O by the second stepping motor 111B operated as many as a predetermined number of steps. The first train wheel 112A and the second train wheel 112B are configured so that the predetermined number of steps applied to one round of the hour hand 31 and the minute hand 32 are the same as each other. That is, the hour hand 31 and the minute hand 32 have the same rotation angle for every one step. The predetermined number of steps is desirably a multiple of 60, and is more desirably a value obtained by multiplying 60 by the N-th power of 2 (N is an integer of 1 or greater). A speed reduction ratio of the third train wheel 112C is set so that the second hand 33 is rotated once around the first rotation axis O by the third stepping motor 111C operated as many as 60 steps. The third train wheel 112C is configured so that the number of steps applied to one round of the second hand 33 is 60.

Operation of Timepiece

Next, an operation of the timepiece 1 according to the first embodiment will be described.

In accordance with an input from the input unit 70, the main control unit 80 switches the operation mode to be performed by the timepiece 1. Here, the operation modes include the timepiece mode, the chronograph mode, the timer mode, and the dual time mode which are described above. The time measurement in the chronograph mode includes causing the hour hand 31 to display a split time. Each operation mode is switched by operating the input unit 70.

In a case where the timepiece mode is selected, the main control unit 80 controls the sixth stepping motor 111F so that the mode hand 36 indicates a character string (character string marked as "Mode 1" in the illustrated example) meaning the timepiece mode in the mode scale 24. In a case where the chronograph mode is selected, the main control unit 80 controls the sixth stepping motor 111F so that the mode hand 36 indicates a character string (character string marked as "Mode 2" in the illustrated example) meaning the chronograph mode in the mode scale 24.

Figure 3:
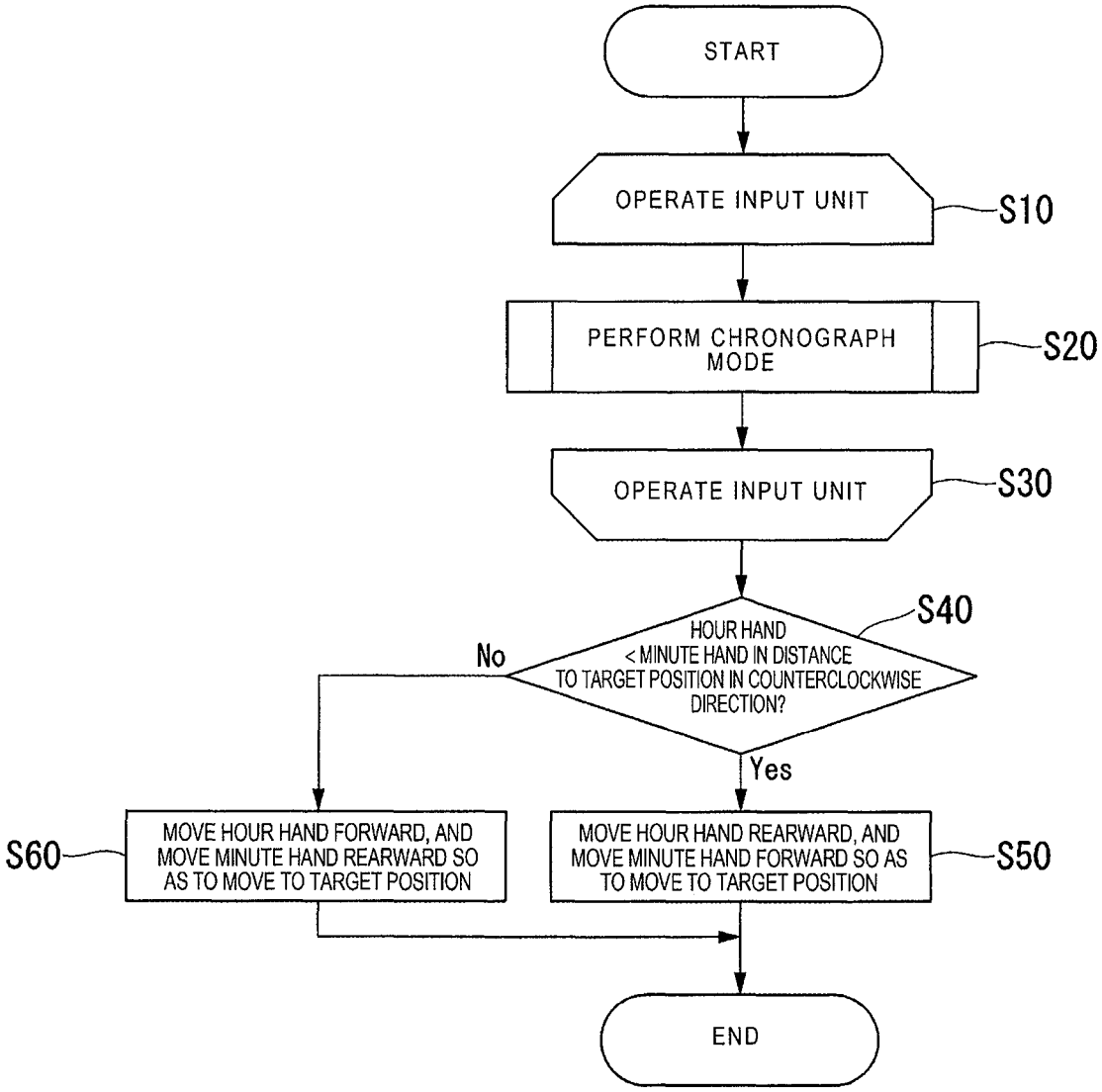
FIG. 3 is a flowchart illustrating a flow in a switching process of an operation mode performed by the timepiece according to the first embodiment.
Figure 4:
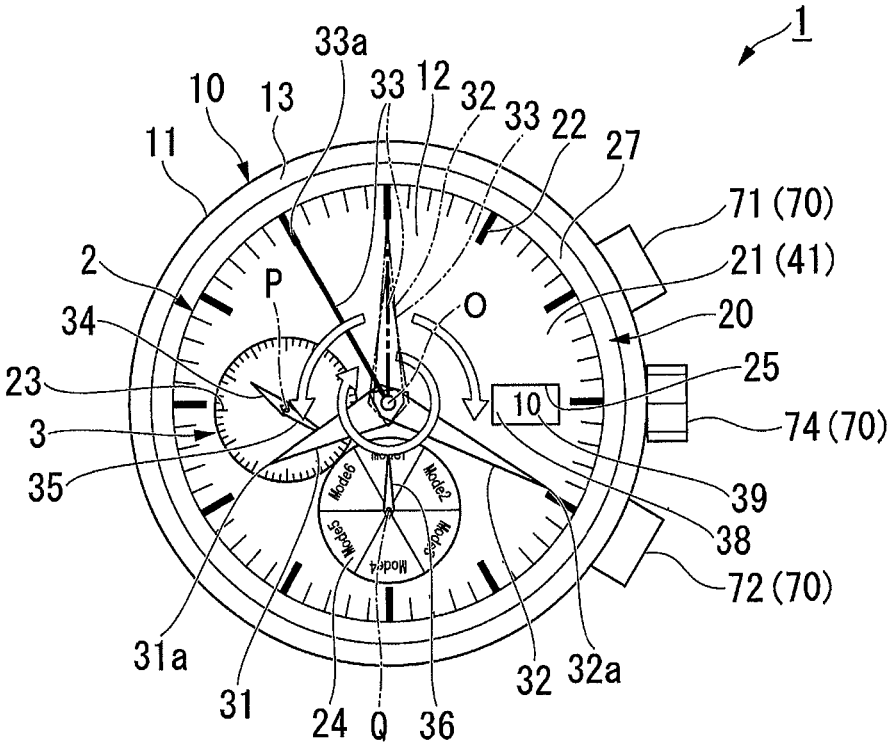
FIG. 4 is a view for describing an operation performed when the operation mode of the timepiece according to the first embodiment is switched.

FIG. 3 is a flowchart illustrating a flow in a switching process of the operation mode performed by the timepiece according to the first embodiment. FIG. 4 is a view for describing the operation performed when the operation mode of the timepiece according to the first embodiment is switched.

As illustrated in FIG. 3, if the input unit 70 (for example, the crown 74) is operated in a case where the operation mode other than the chronograph mode including the timepiece mode is selected (Step S10), the main control unit 80 proceeds to the chronograph mode so as to perform a process in Step S20. The main control unit 80 performs the process in Step S20 until the input unit 70 is operated again (Step S30). If the input unit 70 is operated again in step S30, the main control unit 80 switches the operation mode from the chronograph mode to the operation mode other than the chronograph mode. The process in Step S20 will be described later. In a case where the chronograph mode is selected, the main control unit 80 controls the fourth stepping motor 111D and the fifth stepping motor 111E so that the small timepiece unit 3 displays the current time displayed by the main timepiece unit 2 in the case where the timepiece mode is selected.

If the input unit 70 is operated again in Step S30, the main control unit 80 performs processes in Steps S40 to S60. In Step S40 to S60, the main control unit 80 controls the hour hand 31 and the minute hand 32 so as to be rotated to each target position in mutually opposite directions.

Specifically, in Steps S40 to S60, the following processes are performed. In Step S40, the main control unit 80 determines whether or not a distance (angle) in the counterclockwise direction from the current position to the target position of the hour hand 31 is shorter than a distance (angle) in the counterclockwise direction from the current position to the target position of the minute hand 32. The target position of the hour hand 31 and the minute hand 32 is the position of the hour hand 31 and the minute hand 32 after the operation mode is switched. For example, in a case where the operation mode is switched from the chronograph mode to the timepiece mode, the target position of the hour hand 31 and the minute hand 32 is a position indicating the current time. In a case where the main control unit 80 determines that the distance in the counterclockwise direction from the current position to the target position of the hour hand 31 is shorter than the distance in the counterclockwise direction from the current position to the target position of the minute hand 32 (S40: Yes), the main control unit 80 performs the process in Step S50. In a case where the main control unit 80 determines that the distance in the counterclockwise direction from the current position to the target position of the hour hand 31 is equal to or longer than the distance in the counterclockwise direction from the current position to the target position of the minute hand 32 (S50: Yes), the main control unit 80 performs the process in Step S60.

In Step S50, the main control unit 80 rotates the hour hand 31 rearward in the counterclockwise direction so as to move to the target position, and rotates the minute hand 32 forward in the clockwise direction so as to move to the target position. The main control unit 80 rotates the second hand 33 forward so as to move to the target position. For example, in Step S50, as illustrated in FIG. 4, the target position of the hour hand 31, the minute hand 32, and the second hand 33 is a position of 8 o'clock, 19 minutes, and 55 seconds. In a case where the hour hand 31, the minute hand 32, and the second hand 33 are located at a position of 0 o'clock, the main control unit 80 rotates the hour hand 31 rearward, and rotates the minute hand 32 and the second hand 33 forward.

In Step S60, the main control unit 80 rotates the hour hand 31 forward so as to move to the target position, rotates the minute hand 32 rearward so as to move to the target position. The main control unit 80 rotates the second hand 33 forward so as to moves to the target position.

Through the above-described configuration, the operation mode other than the chronograph mode including the timepiece mode is switched to the chronograph mode, and the chronograph mode is completely switched to the operation mode other than the chronograph mode.

In the present embodiment, in Step S40, Step S50, and Step S60, in a case where the distance in the counterclockwise direction from the current position to the target position of the hour hand 31 is equal to the distance in the counterclockwise direction from the current position to the target position of the minute hand 32, the main control unit 80 rotates the minute hand 32 rearward. However, without being limited thereto, in the case where the distance in the counterclockwise direction from the current position to the target position of the hour hand 31 is equal to the distance in the counterclockwise direction from the current position to the target position of the minute hand 32, the main control unit 80 may rotate the hour hand 32 rearward. For example, in a case where the first train wheel 112A and the second train wheel 112B are configured to have the mutually different number of steps applied to one round of the hour hand 31 and the minute hand 32, it is desirable that one hand having the fewer number of steps applied to one round between the hour hand 31 and the minute hand 32 is rotated rearward.

Subsequently, a process in Step S20 will be described.

Figure 5:
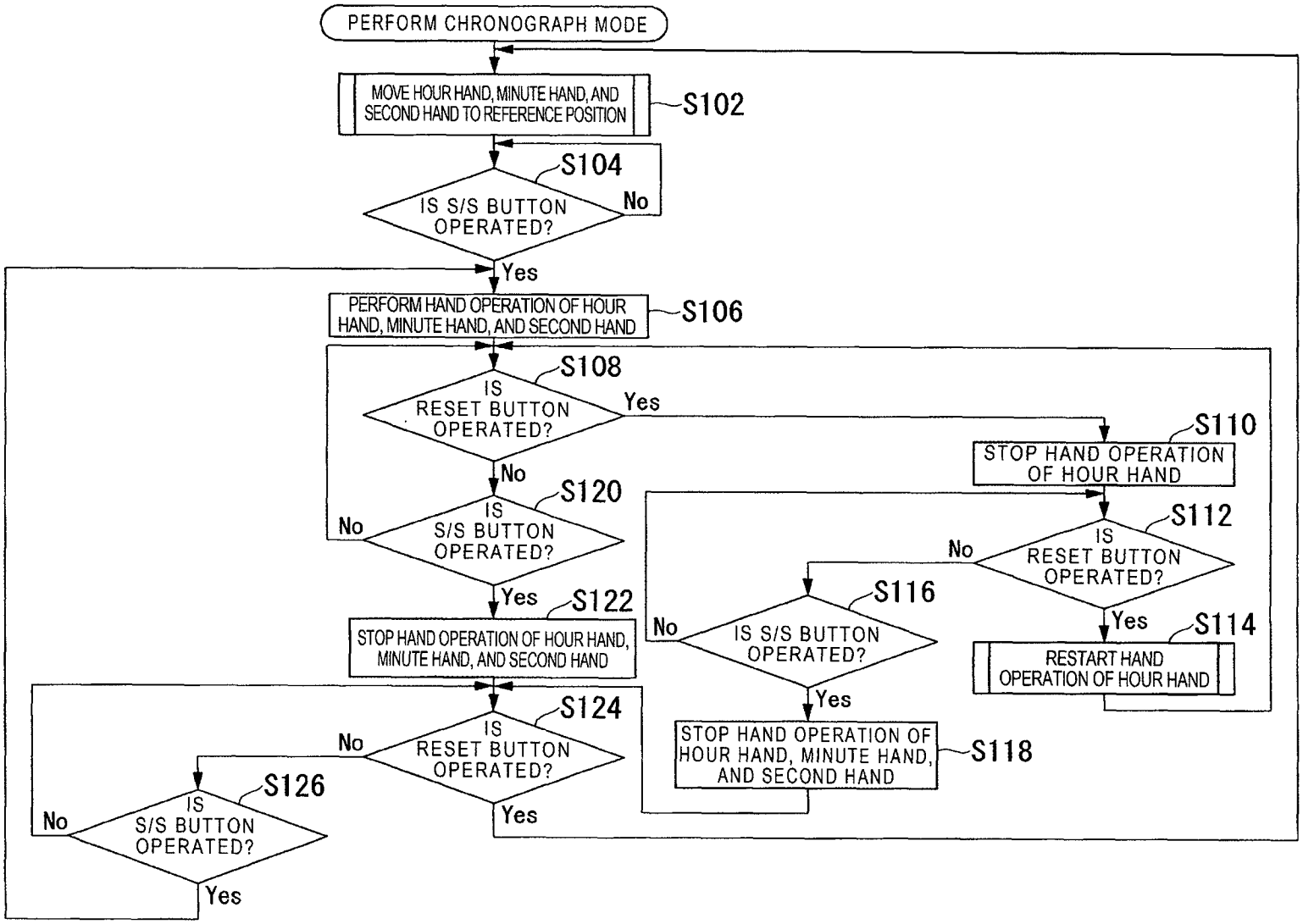
FIG. 5 is a flowchart illustrating a flow in a process of a chronograph mode performed by the timepiece according to the first embodiment.
Figure 6:
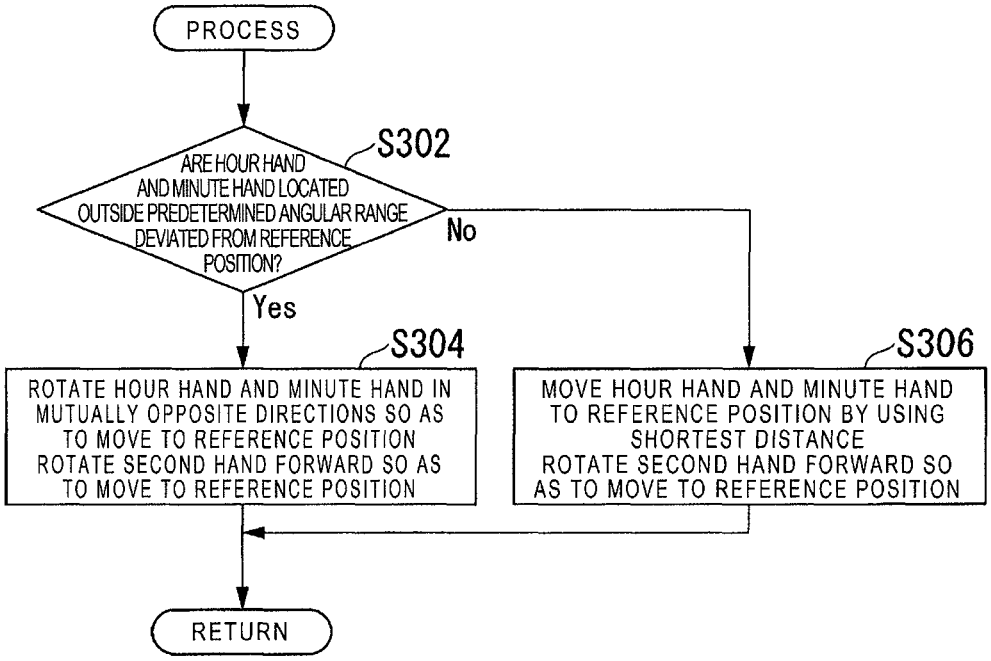
FIG. 6 is a flowchart illustrating a flow of a process in which a hand in the timepiece according to the first embodiment is moved to a reference position.
Figure 7:
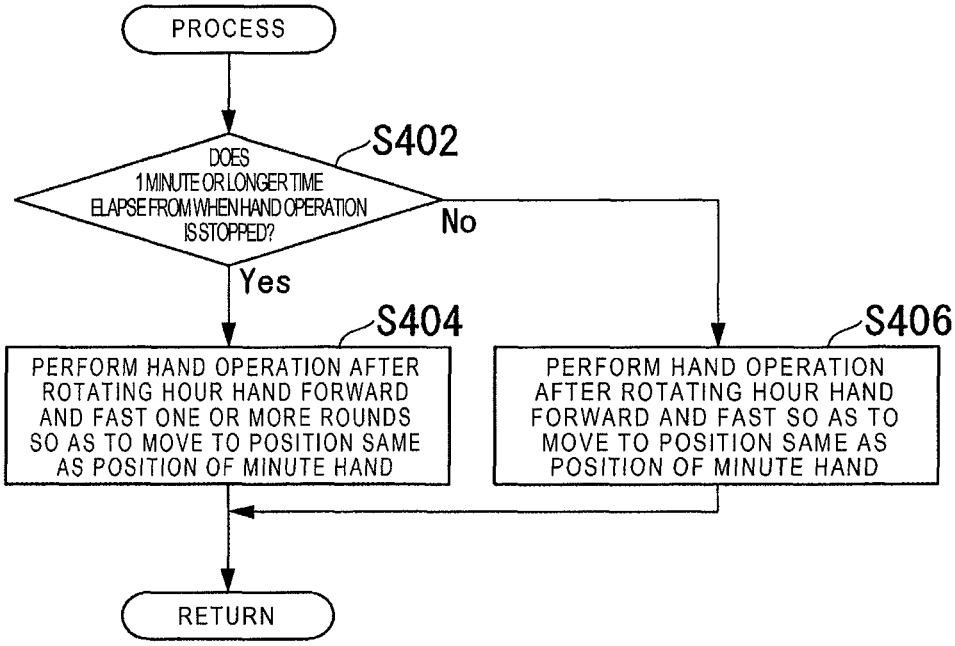
FIG. 7 is a flowchart illustrating a flow of a process in which a hand operation of an hour hand in the timepiece according to the first embodiment is restarted.

FIG. 5 is a flowchart illustrating a flow in a process of the chronograph mode performed by the timepiece according to the first embodiment. FIG. 6 is a flowchart illustrating a flow in a process of moving the hand in the timepiece according to the first embodiment to the reference position. FIG. 7 is a flowchart illustrating a flow in a process of restarting the hand operation of the hour hand in the timepiece according to the first embodiment. FIGS. 8 to 14 are views for describing an operation in the chronograph mode of the timepiece according to the first embodiment. In FIG. 5, the start/stop button is illustrated as "S/S button" (the same in the following drawings). The process illustrated in FIG. 5 corresponds to the process in Step S20 described above.

As illustrated in FIG. 5, if the chronograph mode is selected, in Step S20, the main control unit 80 first performs the process in Step S102.

Step S102

The main control unit 80 moves the hour hand 31, the minute hand 32, and the second hand 33 to the reference position (position of 0 o'clock). Subsequently, the process proceeds to Step S104.

Herein, the process in Step S102 will be described in detail.

As illustrated in FIG. 6, in Step S102, the main control unit 80 first performs the process in Step S302 (hand position determination step).

Step S302

The main control unit 80 determines whether or not the hour hand 31 and the minute hand 32 are located outside a predetermined angular range deviated from the reference position (position of 0 o'clock). The predetermined angular range can be optionally set. For example, the predetermined angular range is a range within 30° around the reference position in both the clockwise direction and the counterclockwise direction. In a case where the main control unit 80 determines that the hour hand 31 and the minute hand 32 are located outside the predetermined angular range deviated from the reference position (S302: Yes), the main control unit 80 proceeds to the process in Step S304 (two-way hand returning step). In a case where the main control unit 80 determines that at least one of the hour hand 31 and the minute hand 32 is not located outside the predetermined angular range deviated from the reference position (S302: No), the main control unit 80 proceeds to the process in Step S306 (shortest hand returning step).

Step S304

Figure 8:
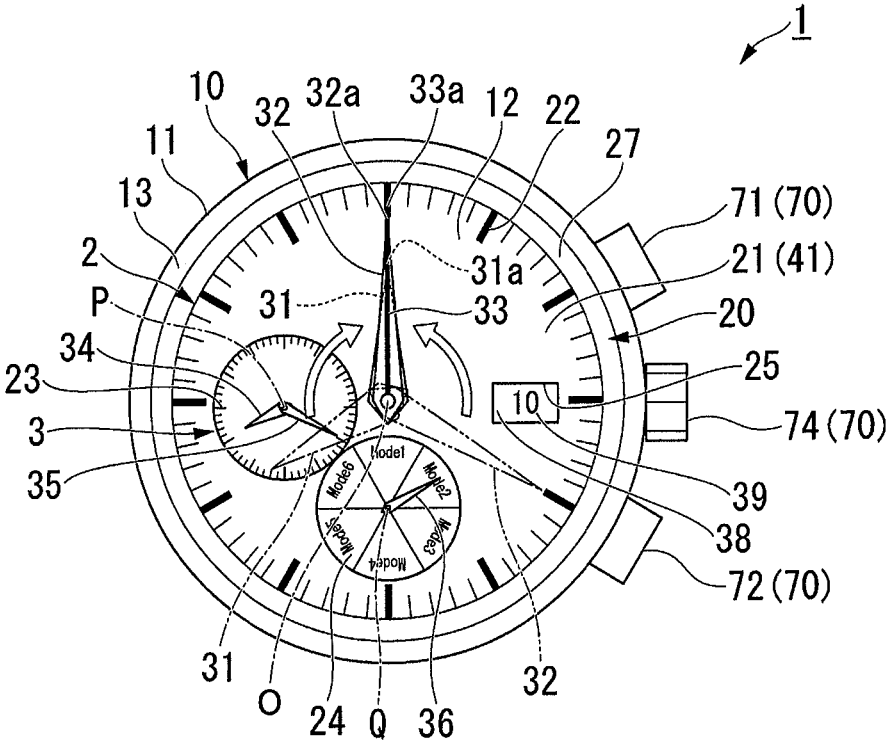
FIG. 8 is a view for describing an operation in the chronograph mode of the timepiece according to the first embodiment.

The main control unit 80 rotates the hour hand 31 and the minute hand 32 in mutually opposite directions so as to move to the reference position. Specifically, the main control unit 80 rotates one of the hour hand 31 and the minute hand 32 forward so as to move to the reference position, and rotates the other of the hour hand 31 and the minute hand 32 rearward so as to move to the reference position. The main control unit 80 rotates the second hand 33 forward so as to move to the reference position. For example, in Step S304, the main control unit 80 moves the hour hand 31 and the minute hand 32 as illustrated in FIG. 8. Specifically, as illustrated in FIG. 8, in a case where the hour hand 31 is located at a position of 240° from the reference position (at a position of 8 o'clock) in the clockwise direction and the minute hand 32 is located at a position of 120° from the reference position (position of 4 o'clock) in the clockwise direction, the main control unit 80 rotates the hour hand 31 forward, and rotates the minute hand 32 rearward. Subsequently, the main control unit 80 proceeds to the process in Step S104. In order to combine a hand rotated forward and a hand rotated rearward with each other in the hour hand 31 and the minute hand 32, for example, it is desirable to combine both of these so that the hour hand 31 and the minute hand 32 do not overlap each other when viewed in the axial direction of the first rotation axis O while moving to the reference position. That is, in the hour hand 31 and the minute hand 32, it is desirable that one hand having longer distance from the current position to the reference position in the counterclockwise direction is rotated forward and the other hand is rotated rearward.

Step S306

Figure 9:
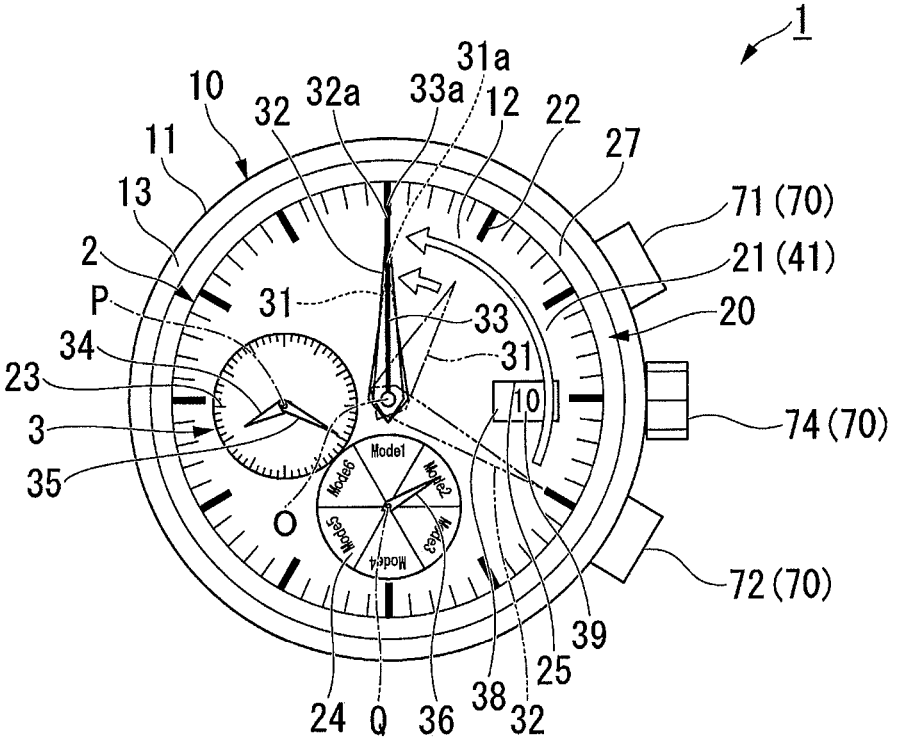
FIG. 9 is a view for describing an operation in the chronograph mode of the timepiece according to the first embodiment.

The main control unit 80 moves the hour hand 31 and the minute hand 32 to the reference position by using the shortest distance in the circumferential direction around the first rotation axis O. The main control unit 80 rotates the second hand 33 forward so as to move to the reference position. For example, in Step S306, the main control unit 80 moves the hour hand 31 and the minute hand 32 as illustrated in FIG. 9. Specifically, as illustrated in FIG. 9, in a case where the hour hand 31 is located at a position (position of 1 o'clock position) of 30° from the reference position in the clockwise direction and the minute hand 32 is located at a position (position of 4 o'clock) of 120° from the reference position in the clockwise direction, the main control unit 80 rotates the hour hand 31 and the minute hand 32 rearward. Subsequently, the main control unit 80 proceeds to the process in Step S104.

Step S104

The main control unit 80 determines whether or not the start/stop button 71 is operated. In a case where the main control unit 80 determines that the start/stop button 71 is operated (S104: Yes), the main control unit 80 proceeds to the process in Step S106 (hand operation starting step) so as to start the time measurement. In a case where the main control unit 80 determines that the start/stop button 71 is not operated (S104: No), the main control unit 80 proceeds to the process in Step S104 again.

Step S106

Figure 10:
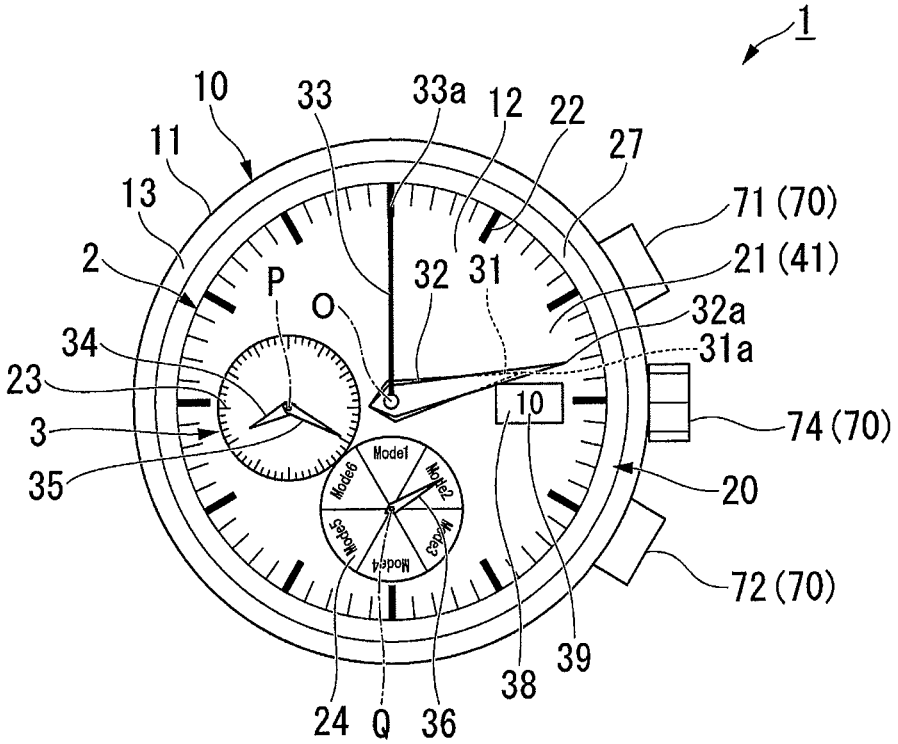
FIG. 10 is a view for describing an operation in the chronograph mode of the timepiece according to the first embodiment.

As illustrated in FIG. 10, the main control unit 80 simultaneously starts the hand operations of the hour hand 31, the minute hand 32, and the second hand 33. Specifically, the main control unit 80 applies a drive pulse to the first stepping motor 111A, the second stepping motor 111B, and the third stepping motor 111C so that the hour hand 31, the minute hand 32, and the second hand 33 are rotated forward. In the chronograph mode according to the present embodiment, the hour hand 31 and the minute hand 32 are caused to indicate a second of the measured time, and the second hand 33 is caused to indicate a minute of the measured time. In the example illustrated in FIG. 10, the timepiece 1 displays 0 minutes and 13 seconds as the elapsed time from when the measurement starts. Subsequently, the main control unit 80 proceeds to the process in Step S108.

In the present embodiment, the number of steps applied to one round of the second hand 33 is 60. Accordingly, the second hand 33 is still located at the reference position for 1 minute after the measurement starts as illustrated in FIG. 10. However, in a case where the third train wheel. 112C is configured so that the number of steps applied to one round of the second hand 33 is greater than 60, the second hand 33 is not located there. For example, in a case where the third train wheel 112C is configured so that the number of steps applied to one round of the second hand 33 is 120, the second hand 33 is rotated one step from the reference position after 30 seconds from when the time measurement starts.

In Step S106, the main control unit 80 simultaneously outputs drive pulses to the first stepping motor 111A and the second stepping motor 111B. In this manner, the first stepping motor 111A and the second stepping motor 111B simultaneously rotate and drive the hour hand 31 and the minute hand 32. The hour hand 31 and the minute hand 32 have the same rotation angle for each step. Accordingly, the hour hand 31 and the minute hand 32 perform the hand operation in a state where both of these overlap each other when viewed in the axial direction of the first rotation axis O.

Step S108

The main control unit 80 determines whether or not the reset button 72 is operated. In a case where the main control unit 80 determines that the reset button 72 is operated (S108: Yes), the main control unit 80 proceeds to the process in Step S110. In a case where the main control unit 80 determines that the reset button 72 is not operated (S108: No), the main control unit 80 proceeds to the process in Step S120.

Step S110

Figure 11:
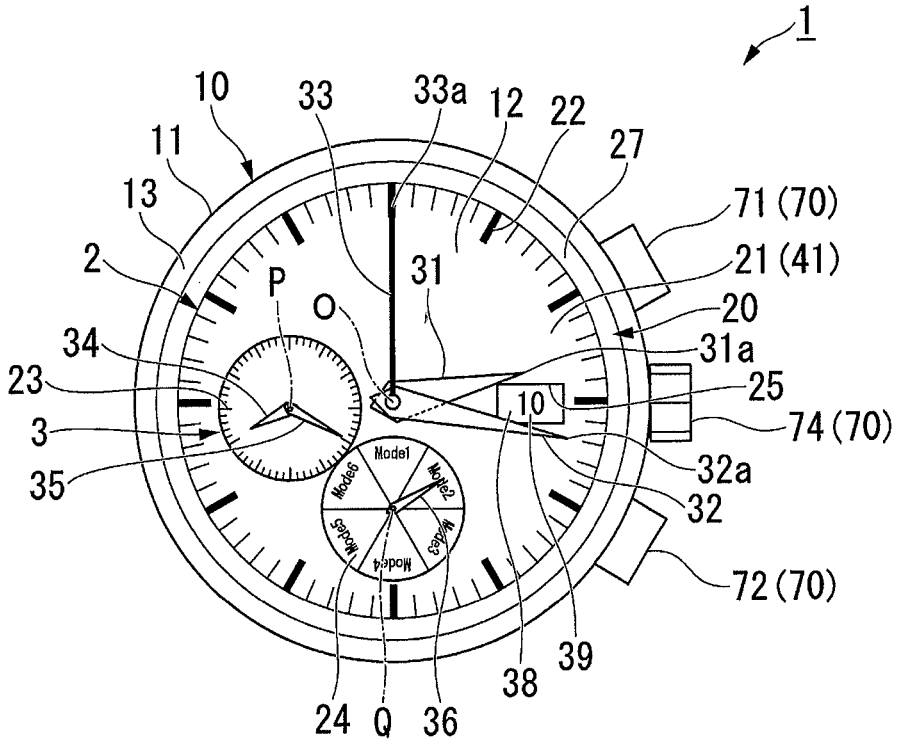
FIG. 11 is a view for describing an operation in the chronograph mode of the timepiece according to the first embodiment.

As illustrated in FIG. 11, the main control unit 80 stops the hand operation of the hour hand 31. While causing the hour hand 31 whose hand operation is stopped to indicate a split time (measured time when the operation is stopped), the main control unit 80 can continue to measure the time by causing the minute hand 32 and the second hand 33 whose hand operations are continued to indicate a total elapsed time from when the measurement starts. In the example illustrated in FIG. 11, the timepiece 1 displays 0 minutes and 13 seconds as the split time, and 0 minute and 17 seconds as the total elapsed time from when the measurement starts. Subsequently, the main control unit 80 proceeds to the process in Step S112.

Step S112

The main control unit 80 determines whether or not the reset button 72 is operated. In a case where the main control unit 80 determines that the reset button 72 is operated (S112: Yes), the main control unit 80 proceeds to the process in Step S114. In a case where the main control unit 80 determines that the reset button 72 is not operated (S112: No), the main control unit 80 proceeds to the process in Step S116.

Step S114

The main control unit 80 restarts the hand operation of the hour hand 31. Subsequently, the main control unit 80 proceeds to the process in Step S108.

Here, the process in Step S114 will be described in detail.

As illustrated in FIG. 7, in Step S114, the main control unit 80 first performs the process in Step S402.

Step S402

The main control unit 80 determines whether or not one minute or a longer time elapses after the hand operation of the hour hand 31 is stopped in step S402. In a case where the main control unit 80 determines that one minute or the longer time elapses after the hand operation of the hour hand 31 is stopped (S402: Yes), the main control unit 80 proceeds to the process in step S404. In a case where the main control unit 80 determines that one minute or the longer time does not elapse after the hand operation of the hour hand 31 is stopped (S402: No), the main control unit 80 proceeds to the process in Step S406.

Step S404

Figure 12:
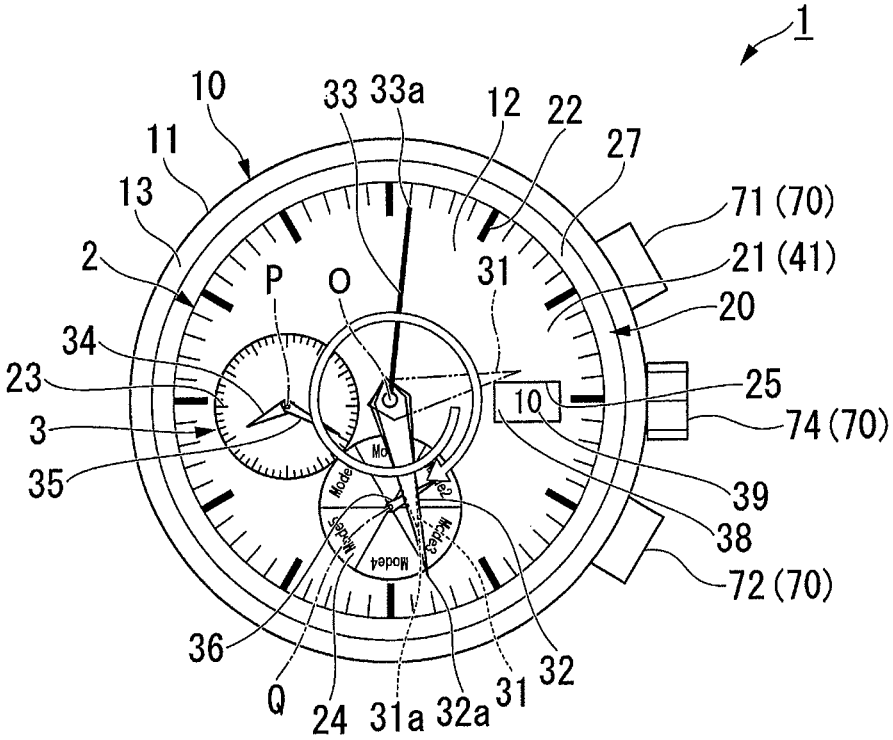
FIG. 12 is a view for describing an operation in the chronograph mode of the timepiece according to the first embodiment.

As illustrated in FIG. 12, the main control unit 80 rotates the hour hand 31 forward and fast so as to move to a position of the minute hand 32. That is, the main control unit 80 rotates the hour hand 31 forward and fast so as to move to a position for indicating the total elapsed time from when the measurement starts. At this time, the main control unit 80 rotates the hour hand 31 one round forward and fast. Thereafter, the main control unit 80 successively rotates the hour hand 31 forward and fast so as to move to a position the same as the position of the minute hand 32. That is, the main control unit 80 rotates the hour hand 31 at least one round forward. Thereafter, the main control unit 80 synchronizes the hour hand 31 with the minute hand 32, and performs the hand operation so that the hour hand 31 and the minute hand 32 indicate the total elapsed time from when the measurement starts. In the example illustrated in FIG. 12, the timepiece 1 displays the split time displayed before restarting the hand operation of the hour hand 31 as 0 minutes and 13 seconds, and displays 1 minute and 28 seconds as the total elapsed time from when the measurement starts. Subsequently, the main control unit 80 proceeds again to the process in Step S108. The main control unit 80 may rotate the hour hand 31 forward in a range of one round or more and less than two rounds in the process of Step S404, or may rotate the hour hand 31 forward in a range of two rounds or more in accordance with the hand operation stopping time of the hour hand 31.

Step S406

Figure 13:
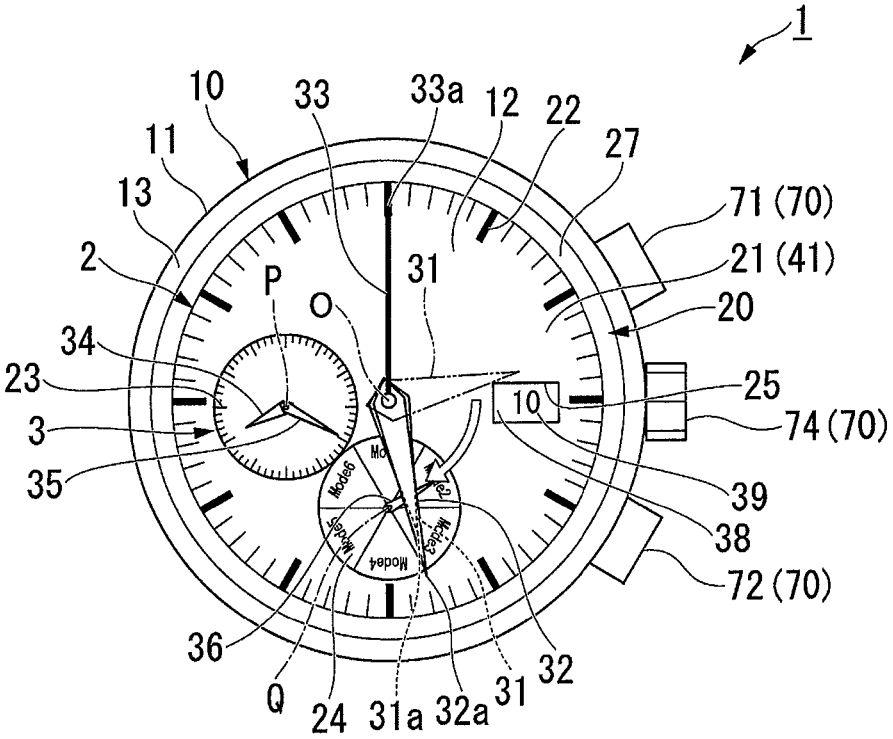
FIG. 13 is a view for describing an operation in the chronograph mode of the timepiece according to the first embodiment.

As illustrated in FIG. 13, the main control unit 80 rotates the hour hand 31 forward and fast so as to move to the position the same as the position of the minute hand 32. That is, the main control unit 80 rotates the hour hand 31 forward and fast so as to move to the position for indicating the total elapsed time from when the measurement starts. Thereafter, the main control unit 80 synchronizes the hour hand 31 with the minute hand 32, and performs the hand operation so that the hour hand 31 and the minute hand 32 indicate the total elapsed time from when the measurement starts. In the example illustrated in FIG. 13, the timepiece 1 displays 0 minutes and 13 seconds as the split time displayed before restarting the hand operation of the hour hand 31, and displays 0 minutes and 28 seconds as the total elapsed time from when the measurement starts. Subsequently, the main control unit 80 proceeds to the process in Step S108 again.

Step S116

The main control unit 80 determines whether or not the start/stop button 71 is operated. In a case where the main control unit 80 determines that the start/stop button 71 is operated (S116: Yes), the main control unit 80 proceeds to the process in Step S118 (hand operation stopping step) so as to stop the time measurement. In a case where the main control unit 80 determines that the start/stop button 71 is not operated (S116: No), the main control unit 80 proceeds to the process in Step S112 again.

Step S118

The main control unit 80 stops the hand operation of the minute hand 32 and the second hand 33. In this manner, the main control unit 80 stops the time measurement. Subsequently, the main control unit 80 proceeds to the process in Step S124.

Step S120

The main control unit 80 determines whether or not the start/stop button 71 is operated. In a case where the main control unit 80 determines that the start/stop button 71 is operated (S120: Yes), the main control unit 80 proceeds to the process in Step S122 (hand operation stopping step) so as to stop the time measurement. In a case where the main control unit 80 determines that the start/stop button 71 is not operated (S120: No), the main control unit 80 proceeds to the process in Step S108 again.

Step S122

Figure 14:
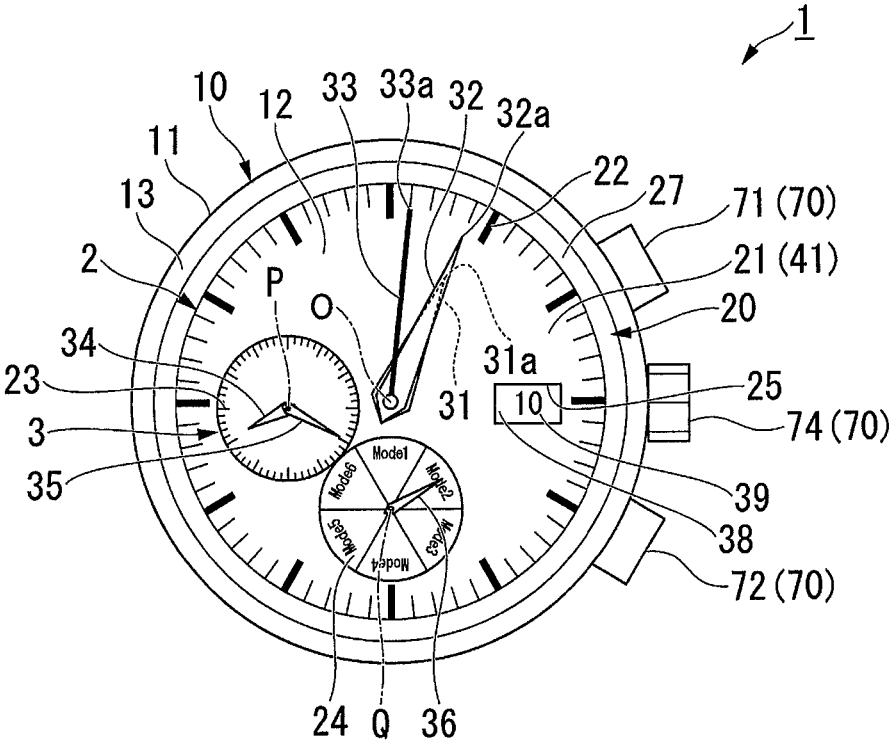
FIG. 14 is a view for describing an operation in the chronograph mode of the timepiece according to the first embodiment.

As illustrated in FIG. 14, the main control unit 80 stops the hand operation of the hour hand 31, the minute hand 32, and the second hand 33. In this manner, the main control unit 80 stops the time measurement. In the example illustrated in FIG. 14, the timepiece 1 displays 1 minute and 4 seconds as the total elapsed time from when the measurement starts until the measurement stops. Subsequently, the main control unit 80 proceeds to the process in Step S124.

Step S124

The main control unit 80 determines whether or not the reset button 72 is operated. In a case where the main control unit 80 determines that the reset button 72 is operated (S124: Yes), the main control unit 80 proceeds to the process in Step S102 again, and waits for starting of re-measurement. In a case where the main control unit 80 determines that the reset button 72 is not operated (S124: No), the main control unit 80 proceeds to the process in Step S126.

Step S126

The main control unit 80 determines whether or not the start/stop button 71 is operated. In a case where the main control unit 80 determines that the start/stop button 71 is operated (S16: Yes), the main control unit 80 proceeds to the process in Step S106 again so as to restart the time measurement. In a case where the main control unit 80 determines that the start/stop button 71 is not operated (S126: No), the main control unit 80 proceeds to the process in Step S124 again.

In this way, the timepiece 1 according to the present embodiment includes the main control unit 80 which performs control as follows. In a case where the chronograph mode is selected, the main control unit 80 starts the time measurement by simultaneously starting the hand operations of the hour hand 31 and the minute hand 32. The main control unit 80 indicates the split time (measured time when stopped) by stopping the hand operation of the hour hand 31, and continues the time measurement by continuing the hand operation of the minute hand 32. According to this configuration, in the chronograph mode, the hour hand 31 and the minute hand 32 can be used so as to display the total elapsed time from when the measurement starts together with the split time. Therefore, in order to display the total elapsed time from when the measurement starts together with the split time, it is possible to omit installation of a new hand other than the hour hand 31 and the minute hand 32 for displaying the total elapsed time from when the measurement starts together with the split time. Therefore, it is possible to omit installation of the drive source such as the stepping motor or the train wheel mechanism which is required due to the installation of the new hand. Accordingly, it is possible to suppress a size increase in an outer shape of the timepiece 1, which is caused by the increased number of configuration components of the timepiece 1.

The timepiece 1 drives the hour hand 31 and the minute hand 32 by using the first stepping motor 111A and the second stepping motor 111B. Accordingly, the respective hand operations of the hour hand 31 and the minute hand 32 can be independently performed. Therefore, a function to display the total elapsed time from when the measurement starts together with the split time can be easily realized.

The timepiece 1 includes the first train wheel 112A and the second train wheel 112B which are configured to have the same number of steps applied to one round of the hour hand 31 and the minute hand 32. In this manner, the rotation angles of the hour hand 31 and the minute hand 32 for each step are equal to each other. Therefore, in a case where the chronograph mode is selected, the hand operation can be performed in a state where the hour hand 31 and the minute hand 32 overlap each other. Accordingly, during the hand operation of the hour hand 31 and the minute hand 32, the relative positions are prevented from being misaligned with each other. Therefore, compared to a case where the hour hand and the minute hand have the mutually different number of steps applied to one round, it is possible to improve the visibility of the measured time indicated by the hour hand 31 and the minute hand 32. Variations in the measured time indicated by the hour hand 31 and the minute hand 32 are suppressed, and thus, the measured time can be accurately displayed.

The main control unit 80 controls the hour hand 31 so as to serve as a hand for indicating a second of the measured time when stopped in a case where the chronograph mode is selected, and controls the minute hand 32 so as to serve as a hand for continuing to measure the second in the case where the chronograph mode is selected. The main control unit 80 controls the second hand 33 so as to serve as a hand for indicating a minute of the measured time in the case where the chronograph mode is selected. In this manner, the hour hand 31, the minute hand 32, and the second hand 33 which indicate the time in a case where the timepiece mode is selected can be used as hands for indicating the measured time in the chronograph mode.

In the case where the chronograph mode is selected, when the hand operation of the hour hand 31 restarts, the main control unit 80 controls the hour hand 31 so that the hour hand 31 is rotated forward and fast to move to the position of the minute hand 32. In this manner, the hour hand 31 can be rotated in the direction the same as the direction during the time measurement. Accordingly, compared to a case where the hour hand 31 is rotated rearward to move to the position of the minute hand 32, the hand operation of the hour hand 31 can be restarted in a state where a user rarely feels unfamiliar with the motion of the hour hand 31.

In a case where the chronograph mode is selected and the hand operation of the hour hand 31 restarts after one minute or a longer time elapses from when the hand operation of the hour hand 31 is stopped, the main control unit 80 rotates the hour hand 31 at least one round. In this manner, the motion of the hour hand 31 can express that the hand operation stopping time of the hour hand 31 is 1 minute or longer.

The main control unit 80 performs a step (Step S304) of rotating the hour hand 31 and the minute hand 32 in mutually opposite directions so as to move to the reference position. In this manner, the hour hand 31 and the minute hand 32 can be moved to the reference position by using the motion different from that during the time measurement. Therefore, it is possible to clearly notify the user that the operation different from that during the time measurement is performed. Moreover, compared to a case where the hour hand 31 and the minute hand 32 are rotated in the same direction so as to move to the reference position, it is possible to provide the user with a dynamic motion.

In a case where at least one of the hour hand 31 and the minute hand 32, each hand operation of which is stopped, is not located outside the predetermined angular range deviated from the reference position, that is, in a case where at least one of the hour hand 31 and the minute hands 32 is located inside predetermined angular range deviated from the reference position, the main control unit 80 performs a step (Step S306) of moving the hour hand 31 and the minute hand 32 to the reference position by using the shortest distance. Therefore, it is possible to suppress an increase in the difference between the movement time of one hand and the movement time of the other hand. In this manner, it is possible to suppress an increase in the movement time of the hour hand 31 and the minute hand 32 to the reference position.

In a case where the chronograph mode is switched to the operation mode other than the chronograph mode, the main control unit 80 controls the hour hand 31 and the minute hand 32 so that the hour hand 31 and the minute hand 32 rotate in mutually opposite directions to respectively move to each target position. In this manner, the hour hand 31 and the minute hand 32 can be moved using a motion different from that during the time measurement. Therefore, it is possible to clearly notify the user that the operation different from that during the time measurement is performed. Moreover, compared to a case where the hour hand 31 and the minute hand 32 are rotated in the same direction so as to move to the target position, it is possible to provide the user with a dynamic motion.

The main control unit 80 performs control so as to rotate one hand rearward counterclockwise by using the short distance in the counterclockwise direction from the current position to the target position in the hour hand 31 and the minute hand 32, and to rotate the other hand forward clockwise. Therefore, compared to a case where one hand is rotated rearward clockwise and the other hand is rotated forward counterclockwise, the movement time of the hour hand 31 and the minute hand 32 can be shortened. Accordingly, it is possible to quickly switch the operation mode.

Here, in order to improve the visibility and the accuracy of the measured time indication using the hands, it is desirable to increase the number of steps applied to one round of the hand indicating the second of the measured time. However, in a case where the number of steps for one round of the hand indicating the measured time is increased, the number of drive pulses applied to the stepping motor in response to the hand operation of the hand in a case where the timepiece mode is selected also increases, thereby increasing power consumption. In a case where the second hand 33 is used as the hand for indicating the second of the measured time, compared to a case where the hour hand 31 or the minute hand 32 is used as the hand for indicating the second of measured time, the number of drive pulses applied to the stepping motor increases in a case where the timepiece mode is selected. In t his manner, in a case where the timepiece 1 is operated using the electric power generated by the solar battery 41, there is a possibility of the electric power shortages.

In the present embodiment, the hour hand 31 and the minute hand 32 indicate the second of the measured time. Accordingly, it is possible to suppress the shortage of the electric power generated by the solar battery 41.

The number of steps applied to one round of the hour hand 31 and the minute hand 32 is a multiple of 60. Therefore, compared to a case where the number of steps applied to one round of the hour hand 31 and the minute hand 32 is smaller than 60, the hour hand 31 and the minute hand 32 can more delicately indicate the measured time. Accordingly, the timepiece 1 can accurately display the measured time.

Moreover, the number of steps applied to one round of the hour hand 31 and the minute hand 32 is a value obtained by multiplying 60 to the N-th power of 2 (N is an integer of 1 or greater). Therefore, it is possible to easily divide the signal output from the frequency divider circuit 60 in the main control unit 80. Accordingly, the timepiece 1 which can accurately display the measured time can be easily configured.

In a case where the chronograph mode is selected, the main control unit 80 causes the small timepiece unit 3 to display the current time displayed in the main timepiece unit 2 in a case where the timepiece mode is selected. Therefore, even in the case where the chronograph mode is selected, the timepiece 1 can display the current time.

The timepiece 1 includes the communication unit 90 capable of transmitting the measured time measured in the chronograph mode to the terminal 9. Therefore, for example, data can be stored by recording the measured time in the terminal 9.

The timepiece 1 according to the present embodiment can select the timepiece mode for causing the hour hand 31, the minute hand 32, and the second hand 33 to display the time, and the chronograph mode for causing the hour hand 31 to indicate the split time. Therefore, installation of new hands other than the hour hand 31, the minute hand 32 and the second hand 33 for displaying the split time can be omitted. Therefore, it is possible to omit installation of the drive source such as the stepping motor or the train wheel which is required due to the installation of the new hand. Accordingly, it is possible to suppress a size increase in an outer shape of the timepiece 1, which is caused by the increased number of configuration components of the timepiece 1.

Modification Example of First Embodiment

Next, a configuration of a timepiece according to a modification example of the first embodiment will be described.

Figure 15:
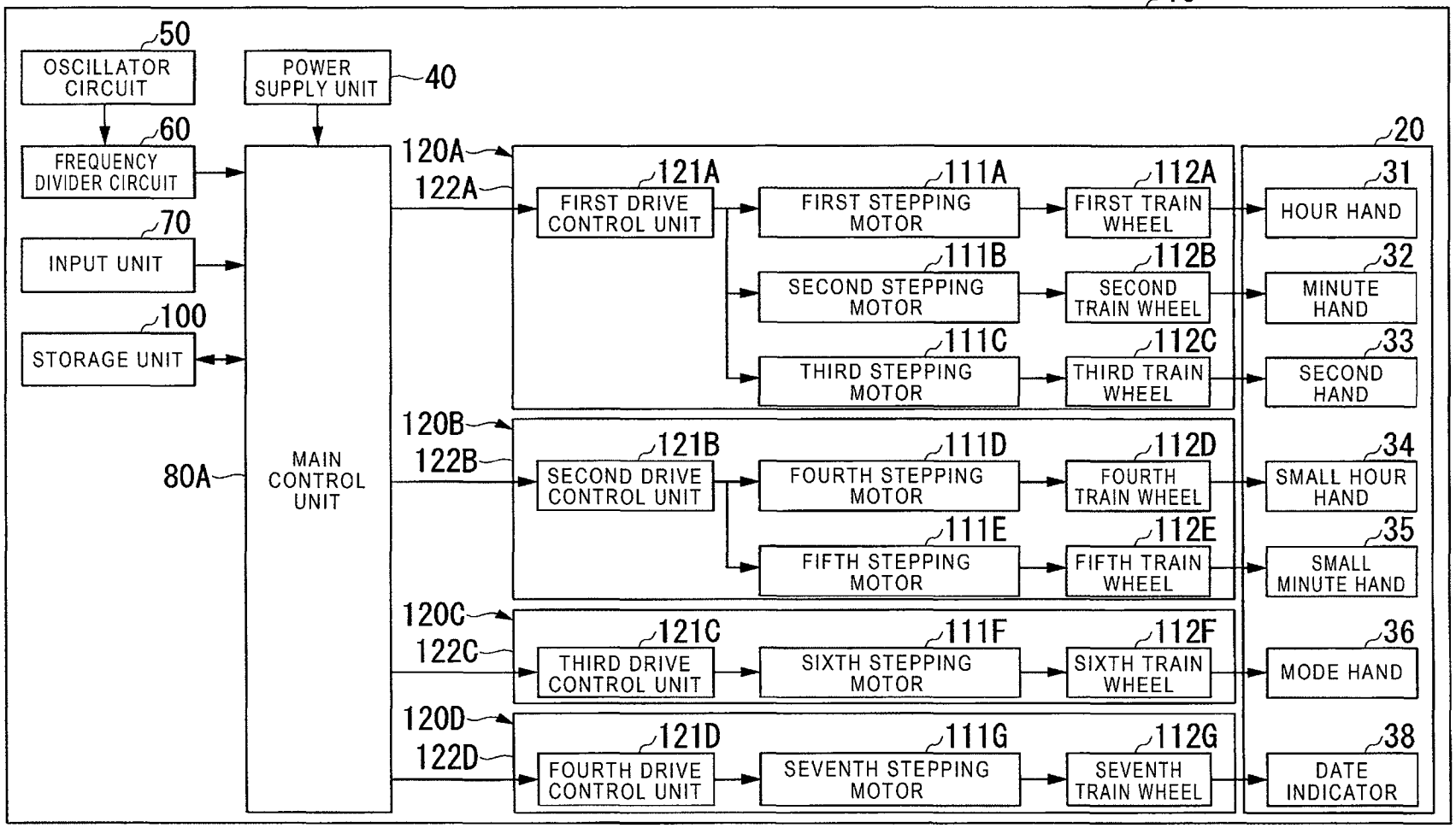
FIG. 15 is a block diagram illustrating a configuration example of a timepiece according to a modification example of the first embodiment.

FIG. 15 is a block diagram illustrating a configuration example of the timepiece according to the modification example of the first embodiment.

As illustrated in FIG. 15, a timepiece 101 includes the case 10, the display unit 20, the power supply unit 40, the oscillator circuit 50, the frequency divider circuit 60, the input unit 70, a main control unit 80A (control unit), the storage unit 100, and a plurality of motor units 120A, 120B, 120C, and 120D. In the following description, in a case where one of the plurality of motor units 120A, 120B, 120C, and 120D is not specified, all of these will be simply referred to as the motor unit. The same applies to other configuration components.

The main control unit 80A controls each configuration element included in the timepiece 1, based on an operation result output by the input unit 70. For example, the main control unit 80A is a central processing unit (CPU). The main control unit 80A outputs an instruction signal for driving the stepping motor to the drive control unit of the motor units.

Each motor unit includes a drive control unit, a stepping motor, a train wheel, and a support body. The oscillator circuit or the storage unit can be disposed inside the motor unit. The support body is configured to serve as a separate unit detachable from the timepiece main body, and this form can be referred to as a so-called cassette type or a cartridge type. In this case, the motor unit is treated as a semi-finished product or an intermediate product in a case where the timepiece main body is a finished product.

Here, the support body includes a substrate, a main plate serving as a base, a receiving plate for holding components disposed on the main plate from the opposite side, other case portions, and a bearing portion to which an axle of the stepping motor joins. The substrate is placed on the main plate. Wiring, the drive control unit, the stepping motor, and the train wheel are placed on the substrate. The components are accommodated in the receiving plate, and are assembled to a unit. An electrode serving as a connection terminal is disposed in the main plate. The electrode plays a role of electrically conducting the electronic component inside the unit and the outside of the unit (timepiece main body side).

A first motor unit 120A drives the hour hand 31, the minute hand 32, and the second hand 33. The first motor unit 120A includes a first drive control unit 121A, a first stepping motor 111A, a second stepping motor 111B, a third stepping motor 111C, a first train wheel 112A, a second train wheel 112B, a third train wheel 112C, and a first support body 122A. For example, the first drive control unit 121A is a motor driver integrated circuit (IC). The first drive control unit 121A generates a drive signal for driving the stepping motors 111A, 111B, and 111C, and drives the stepping motors 111A, 111B, and 111C by using the generated drive signal. The first support body 122A forms an outer shell of the first motor unit 120A. The first support body 122A supports each configuration element of the first motor unit 120A, such as the stepping motors 111A, 111B, and 111C, the train wheels 112A, 112B, and 112C, and the first drive control unit 121A.

A second motor unit 120B drives the small hour hand 34 and the small minute hand 35. The second motor unit 120B includes a second drive control unit 121B, a fourth stepping motor 111D, a fourth train wheel 112D, a fifth train wheel 112E, and a second support body 122B. For example, the second drive control unit 121B is a motor driver IC. The second drive control unit 121B generates a drive signal for driving the fourth stepping motor 111D, and drives the fourth stepping motor 111D by using the generated drive signal. The second support body 122B forms an outer shell of the second motor unit 120B. The second support body 122B supports each configuration element of the second motor unit 120B, such as the fourth stepping motor 111D, the train wheels 112D and 112E, and the second drive control unit 121B.

A third motor unit 120C drives the mode hand 36. The third motor unit 120C includes a third drive control unit 121C, a sixth stepping motor 111F, a sixth train wheel 112F, and a third support body 122C. For example, the third drive control unit 121C is a motor driver IC. The third drive control unit 121C generates a drive signal for driving the sixth stepping motor 111F, and drives the sixth stepping motor 111F by using the generated drive signal. The third support body 122C forms an outer shell of the third motor unit 120C. The third support body 122C supports each configuration element of the third motor unit 120C, such as the sixth stepping motor 111F, the sixth train wheel 112F, and the third drive control unit 121C.

A fourth motor unit 120D drives the date indicator 38. The fourth motor unit 120D includes a fourth drive control unit 121D, a seventh stepping motor 111G, a seventh train wheel 112G, and a fourth support body 122D. For example, the fourth drive control unit 121D is a motor driver IC. The fourth drive control unit 121D generates a drive signal for driving the seventh stepping motor 111G, and drives the seventh stepping motor 111G by using the generated drive signal. The fourth support body 122D forms an outer shell of the fourth motor unit 120D. The fourth support body 122D supports each configuration element of the fourth motor unit 120D, such as the seventh stepping motor 111G, the seventh train wheel 112G, and the fourth drive control unit 121D.

In this way, even if the timepiece 101 adopts the configuration having the motor unit, the main control unit 80A performs the same control as that of the main control unit 80 according to the above-described first embodiment. Accordingly, it is possible to achieve an operation effect the same as that according to the above-described first embodiment.

Second Embodiment

Next, an operation of a timepiece according to a second embodiment will be described.

Figure 16:
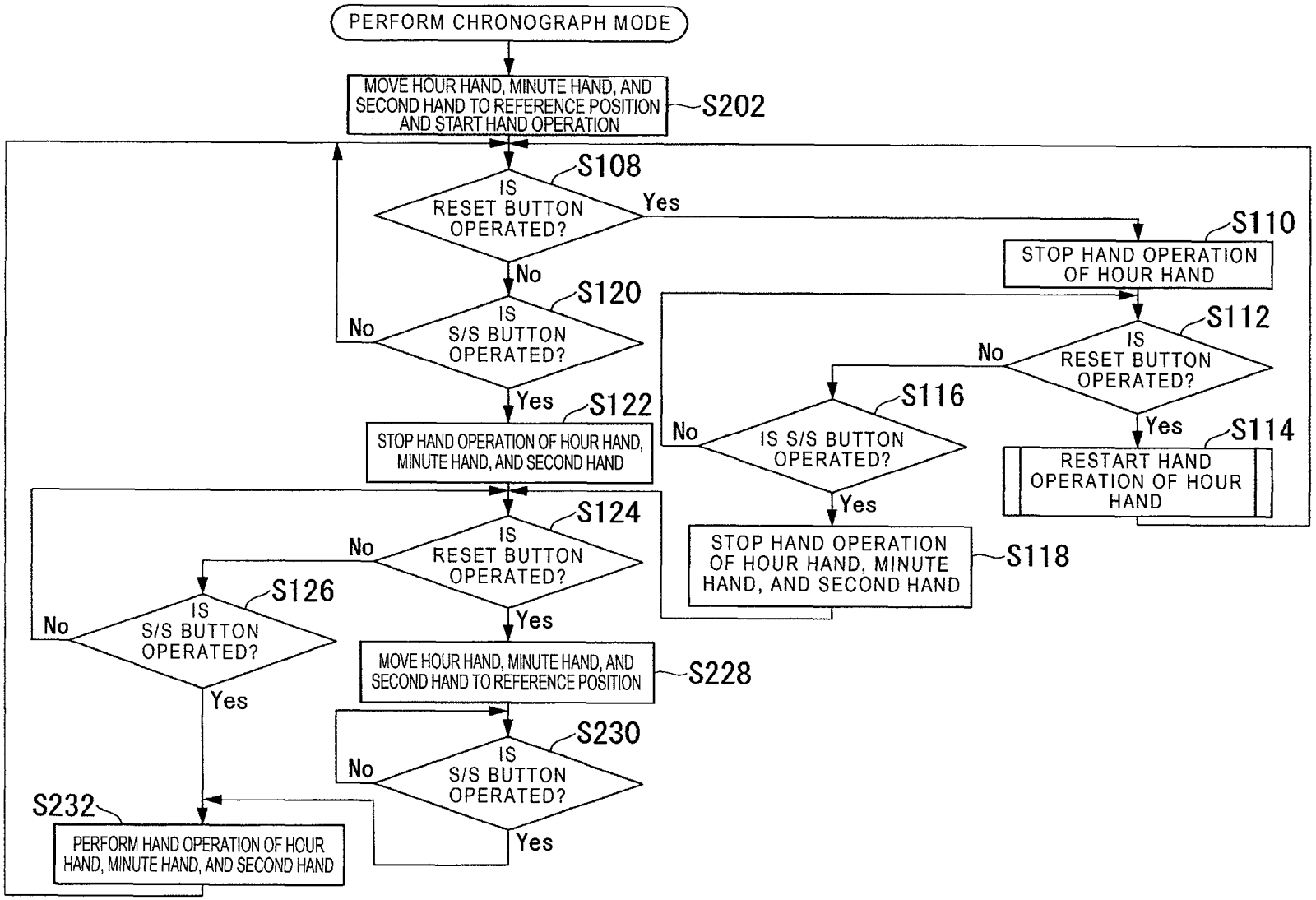
FIG. 16 is a flowchart illustrating a flow in a process of a chronograph mode performed by the timepiece according to a second embodiment.

FIG. 16 is a flowchart illustrating a flow in a process of a chronograph mode performed by the timepiece according to the second embodiment.

In the first embodiment illustrated in FIGS. 3 and 5, in a case where the input unit 70 (for example, the crown 74) is operated (Step S10), the main control unit 80 moves the hour hand 31, the minute hand 32, and the second hand 33 to the reference position (Step S304 and Step S306). In a case where the start/stop button 71 is operated (S104: Yes), the main control unit 80 starts the time measurement. In contrast, in the second embodiment illustrated in FIG. 16, in a case where the input unit 70 (for example, the start/stop button 71) is operated (Step S10), the main control unit 80 moves the hour hand 31, the minute hand 32, and the second hand 33 toward the reference position, and starts the time measurement (Step S202). This point is different from that according to the first embodiment. The same reference numerals will be given to configurations and process contents which are the same as those of the first embodiment, and detailed description thereof will be omitted.

In accordance with an input from the input unit 70, the main control unit 80 switches the operation mode (timepiece mode, chronograph mode, timer mode, or dual time mode) performed by the timepiece 1. In the present embodiment, in a case where the start/stop button 71 is operated, if the timepiece mode is selected (Step S10), the main control unit 80 proceeds to the chronograph mode, and performs the process in Step S20. The main control unit 80 performs the process in Step S20 until the start/stop button 71 is operated again (for example, pressed long) (Step S30). If the chronograph mode is selected, in Step S20, the main control unit 80 first proceeds to the process in Step S202.

Step S202

The main control unit 80 moves the hour hand 31, the minute hand 32, and the second hand 33 toward the reference position, and simultaneously starts the hand operations of the hour hand 31, the minute hand 32, and the second hand 33. The main control unit 80 starts the time measurement from when the start/stop button 71 is operated in Step S10 (refer to FIG. 3). The main control unit 80 moves the hour hand 31, the minute hand 32, and the second hand 33 from the position for indicating the current time in the timepiece mode toward the reference position. In a case where the hour hand 31, the minute hand 32, and the second hand 33 reach the position corresponding to the elapsed time from when the measurement starts while moving toward the reference position, the main control unit 80 controls the hand driving so as to sequentially switch the hand operations of the time measurement. Subsequently, the main control unit 80 proceeds to the process in Step S108. Step S202 may include the determination process the same as that in Step S302 in the first embodiment and the processes the same as those in Step S304 and Step S306.

Step S124

In the first embodiment illustrated in FIG. 5, in a case where the main control unit 80 determines that the reset button 72 is operated (S124: Yes), the main control unit 80 proceeds to the process in Step S102. In contrast, in the second embodiment, in a case where the main control unit 80 determines that the reset button 72 is operated (S124: Yes), the main control unit 80 proceeds to the process in Step S228.

Step S228

The main control unit 80 moves the hour hand 31, the minute hand 32, and the second hand 33 to the reference position. Subsequently, the main control unit 80 proceeds to the process in Step S230.

Step S230

The main control unit 80 determines whether or not the start/stop button 71 is operated. In a case where the main control unit 80 determines that the start/stop button 71 is operated (S230: Yes), the main control unit 80 proceeds to the process in Step S232 so as to start the time measurement. In a case where the main control unit 80 determines that the start/stop button 71 is not operated (S230: No), the main control unit 80 proceeds to the process in Step S230 again.

Step S232

The main control unit 80 simultaneously starts the hand operations of the hour hand 31, the minute hand 32, and the second hand 33. A specific process is the same as that in Step S106 according to the first embodiment.

Step S126

In the first embodiment illustrated in FIG. 5, in a case where the main control unit 80 determines that the start/stop button 71 is operated (S126: Yes), the main control unit 80 proceeds to the process in Step S106. In contrast, in the second embodiment, in a case where the main control unit 80 determines that the start/stop button 71 is operated (S126: Yes), the main control unit 80 proceeds to the process in Step S232 so as to restart the time measurement.

In this way, according to the present embodiment, in accordance with the input from the start/stop button 71, the main control unit 80 moves the hour hand 31, the minute hand 32, and the second hand 33 to the reference position, and starts the time measurement. Therefore, in a case where the timepiece mode is selected, the chronograph mode can be selected and the time measurement can be started in the chronograph mode by performing one operation of the start/stop button 71. Accordingly, the timepiece 1 can quickly start the time measurement.

In the above-described respective embodiments, when the split time is indicated by the hour hand 31, the hand operation of the hour hand 31 is stopped by operating the start/stop button 71. However, a method of stopping the hand operation of the hour hand 31 is not limited thereto. For example, the communication unit 90 is formed to be capable of receiving radio waves transmitted from a timer mat (external device) installed at a predetermined point on a marathon course, and the main control unit 80 causes the communication unit 90 to receive the radio waves transmitted from the timer mat. In this manner, the main control unit 80 may perform at least one of a process of stopping the hand operation of the hour hand 31 and a process of stopping the hand operation of the hour hand 31. According to this configuration, when a user passes near the timer mat installed on the marathon course, the time measurement can automatically start, or the split time can be automatically measured and displayed. Therefore, the timepiece 1 can easily measure the split time.

The present invention is not limited to the embodiments described above with reference to the drawings, and various modification examples are conceivable in the technical scope of the invention.

For example, in the above-described embodiments, in a case where the chronograph mode is selected, the split time is displayed by stopping the hand operation of the hour hand 31. However, the hand for stopping the hand operation is not limited to the hour hand 31. For example, a configuration may be adopted in which the split time is displayed by stopping the hand operation of the minute hand 32.

In the above-described embodiments, when the split time is displayed, the hand operation of the hour hand 31 is stopped, and the hand operation of the minute hand 32 and the second hand 33 is continued. However, the present invention is not limited thereto. For example, when the split time is displayed, the hand operation of the hour hand 31 and the second hand 33 may be stopped. In this manner, a configuration may be adopted in which the hour hand 31 indicates the second of the split time and the second hand 33 indicates the minute of the split time.

In the above-described embodiments, the time measurement is performed using the hour hand 31, the minute hand 32, and the second hand 33. However, the present invention is not limited thereto. At least two hands of the hour hand 31, the minute hand 32, and the second hand 33 may be used. In this manner, a configuration may be adopted in which the hand operation of one hand is stopped so as to indicate the measured time when stopped and the time measurement of the other hand is continued by continuing the hand operation of the other hand.

In the above-described embodiments, as a condition for switching the operation mode in Steps S10 and S30, the main control unit 80 switches the operation mode under a condition that a specific member of the input unit 70 is operated (including long pressing). However, the present invention is not limited thereto. For example, as the condition for switching the operation mode, the main control unit may switch the operation mode under a condition that a plurality of members of the input unit 70 are simultaneously operated.

In the above-described embodiments, the mode hand 36 is driven using the drive force of the sixth stepping motor 111F. However, the present invention is not limited thereto. For example, the mode hand 36 may be configured to be driven using a force generated by a user operating the input unit 70 (for example, the crown 74) as a power source.

Alternatively, the configuration elements in the above-described embodiments can be appropriately substituted with well-known configuration elements within the scope not departing from the gist of the present invention. The above-described respective embodiments and modification examples may be appropriately combined with each other.

What is claimed is:

1. A timepiece capable of selecting a timepiece mode and a chronograph mode, the timepiece comprising:

an hour hand, a minute hand, and a second hand which indicate a current time in a case where the timepiece mode is selected; and a control unit that performs control so as to start measuring time by simultaneously starting hand operations of at least two hands of the hour hand, the minute hand, and the second hand in a case where the chronograph mode is selected, wherein when the hand operation of one hand of the at least two hands is stopped, the control unit performs control so as to indicate the time when the hand operation of one hand of the at least two hands is stopped, and to continue to measure the time by continuing the hand operation of the other hand of the at least the two hands.

2. The timepiece according to claim 1, further comprising:

a first motor that drives the hour hand;

a second motor that drives the minute hand; and a third motor that drives the second hand, wherein in the case where the timepiece mode is selected, the control unit causes the first motor, the second motor, and the third motor to drive the hour hand, the minute hand, and the second hand, and in the case where the chronograph mode is selected, the control unit causes at least two motors of the first motor, the second motor, and the third motor to drive at least the two hands.

3. The timepiece according to claim 1, further comprising:

a train wheel mechanism configured to have the same number of steps applied to one round of at least the two hands.

4. The timepiece according to claim 3, wherein the control unit controls the hour hand and the minute hand in the timepiece mode so as to serve as at least the two hands in the chronograph mode, which are the hands for indicating a second of the time.

5. The timepiece according to claim 4, wherein the control unit performs control so that the second hand in the case where the timepiece mode is selected functions as a hand for indicating a minute of the time in the case where the chronograph mode is selected.

6. The timepiece according to claim 4, further comprising:

a first motor that drives the hour hand;

a second motor that drives the minute hand; and a solar battery that generates power for driving the first motor and the second motor.

7. The timepiece according to claim 1, wherein in the case where the chronograph mode is selected, when the hand operation of one hand restarts, the control unit performs control so that one hand is forwarded fast to a position of the other hand in a clockwise direction.

8. The timepiece according to claim 7, wherein in a case where the chronograph mode is selected and one minute or a longer time elapses until the hand operation of one hand restarts from when the hand operation of one hand stops, the control unit causes one hand to rotate at least one round.

9. The timepiece according to claim 1, wherein at least the two hands include a 1st hand and a 2nd hand, and wherein in the case where the chronograph mode is selected, the control unit performs a hand operation starting step of controlling the 1st hand and the 2nd hand so as to perform each hand operation from a reference position, a hand operation stopping step of stopping the hand operation of the 1st hand and the 2nd hand, a hand position determination step of determining whether or not the 1st hand and the 2nd hand, each hand operation of which is stopped, are located outside a predetermined angular range deviated from the reference position, a two-way hand returning step of moving the 1st hand and the 2nd hand to the reference position by rotating the 1st hand and the 2nd hand in mutually opposite directions, in a case where it is determined in the hand position determination step that the 1st hand and the 2nd hand are located outside the predetermined angular range deviated from the reference position, and a shortest hand returning step of moving the 1st hand and the 2nd hand to the reference position by using a shortest distance, in a case where it is determined in the hand position determination step that at least one hand in the 1st hand and the 2nd hand is not located outside the predetermined angular range deviated from the reference position.

10. The timepiece according to claim 1, wherein in a case where the control unit switches the chronograph mode to an operation mode including the timepiece mode other than the chronograph mode, the control unit controls a pair of hands included in at least the two hands so as to respectively rotate to each target position of the pair of two hands in mutually opposite directions.

11. The timepiece according to claim 10, wherein in the pair of hands included in at least the two hands, the control unit controls one hand having a short distance from a current position to the target position in a counterclockwise direction so as to rotate rearward counterclockwise, and controls the other hand so as to rotate forward clockwise.

12. The timepiece according to claim 1, further comprising:

a train wheel mechanism configured to have the same number of steps applied to one round of at least the two hands, wherein the number of steps is a multiple of 60.

13. The timepiece according to claim 1, further comprising:

a train wheel mechanism configured to have the same number of steps applied to one round of at least the two hands, wherein when N is an integer equal to or greater than 1, the number of steps is a value obtained by multiplying 60 by the N-th power of 2.

14. The timepiece according to claim 1, further comprising:

an auxiliary display unit capable of displaying information of a mode different from the timepiece mode and the chronograph mode, wherein in the case where the chronograph mode is selected, the control unit causes the auxiliary display unit to display the current time displayed in the case where the timepiece mode is selected.

15. The timepiece according to claim 1, further comprising:

a communication unit capable of at least any one of transmitting the time when the hand operation of one hand of the at least two hand is stopped to an external device and receiving an external radio wave for performing at least one process of a process for starting and a process for stopping the hand operation of one hand.

16. The timepiece according to claim 1, further comprising:

an input unit that is operated in a case of selecting the chronograph mode or in a case of starting measuring the time in the case where the chronograph mode is selected, wherein in accordance with an input from the input unit, the control unit moves at least the two hands toward each reference position, and starts the time measurement.

* * * * *